US012173387B2

(12) United States Patent
Jarvis et al.

(10) Patent No.: US 12,173,387 B2
(45) Date of Patent: Dec. 24, 2024

(54) METAL ALLOY

(71) Applicant: VSCA AS, Nesbru (NO)

(72) Inventors: David Jarvis, Nesbru (NO); Rosanna Jarvis, Nesbru (NO)

(73) Assignee: VSCA AS, Nesbru (NO)

( * ) Notice: Subject to any disclaimer, the term of this patent is extended or adjusted under 35 U.S.C. 154(b) by 0 days.

(21) Appl. No.: 17/757,731

(22) PCT Filed: Dec. 18, 2020

(86) PCT No.: PCT/EP2020/087128
§ 371 (c)(1),
(2) Date: Jun. 20, 2022

(87) PCT Pub. No.: WO2021/123239
PCT Pub. Date: Jun. 24, 2021

(65) Prior Publication Data

US 2023/0080442 A1 Mar. 16, 2023

(30) Foreign Application Priority Data

Dec. 20, 2019 (EP) ..... 19218935

(51) Int. Cl.
*C22C 19/05* (2006.01)
*C25C 3/12* (2006.01)

(52) U.S. Cl.
CPC ..... *C22C 19/058* (2013.01); *C25C 3/12* (2013.01)

(58) Field of Classification Search
CPC ..... C23C 3/12; C22C 19/03–19/07
See application file for complete search history.

(56) References Cited

U.S. PATENT DOCUMENTS 4,614,569 A * 9/1986 Duruz ..... C25C 7/025 205/406
4,956,068 A * 9/1990 Nguyen ..... C23C 26/00 427/337

(Continued)

FOREIGN PATENT DOCUMENTS

CN 102011144 A 4/2011
CN 102251152 A 11/2011

(Continued)

OTHER PUBLICATIONS

NL7117844A, Google Machine translation provided on Jul. 18, 2023, Jun. 26, 1973, entire translation (Year: 1973).*

(Continued)

*Primary Examiner* — Alexander W Keeling
(74) *Attorney, Agent, or Firm* — Chiesa Shahinian & Giantomasi PC

(57) ABSTRACT

The present invention relates to conductive multicomponent multiphase metal alloy. The metal alloy has the following (in atom-%):Ni, in a total amount of 35-70; wherein the remaining 30-65 comprises at least three elements selected from the list consisting of Sn, Nb, Ta, B, Cr, Ce, Fe, La, Nd, Sm, Gd, Ti, Zr, Mn, Hf, Si, P, Al, Y and V in a total amount of at least 30. The metal alloy comprises at least three distinct crystalline phases, at least one phase being an intermetallic phase. The present invention also relates to an electrode material comprising said alloy, to a method for forming a coating on said alloy, and to a method for manufacturing said alloy.

21 Claims, 7 Drawing Sheets

(56) References Cited

U.S. PATENT DOCUMENTS

| | | | | |
|---|---|---|---|---|
| 5,904,828 | A * | 5/1999 | Sekhar | C25C 3/12 204/290.01 |
| 2001/0017267 | A1 | 8/2001 | Duruz et al. | |
| 2003/0226760 | A1* | 12/2003 | Duruz | C25C 3/12 205/373 |
| 2005/0194066 | A1 | 9/2005 | Duruz et al. | |
| 2005/0205431 | A1 | 9/2005 | Nguyen et al. | |
| 2009/0041615 | A1* | 2/2009 | James | C22C 30/00 420/443 |
| 2015/0159287 | A1* | 6/2015 | Sun | C25C 3/12 164/47 |
| 2019/0010623 | A1* | 1/2019 | Kim | C25D 3/562 |

FOREIGN PATENT DOCUMENTS

| | | | |
|---|---|---|---|
| JP | S50-19616 | A | 3/1975 |
| JP | H04-66633 | A | 3/1992 |
| JP | H04-157089 | A | 5/1992 |
| NL | 7117844 | A | 6/1973 |
| TW | 201643262 | A | 12/2016 |
| WO | 200142534 | A2 | 6/2001 |
| WO | 2010/026131 | A2 | 3/2010 |

OTHER PUBLICATIONS

Office Action mailed Apr. 17, 2023 in connection with Chinese Patent Application No. 202080094971.0, 13 pgs. (including translation).

Extended European Search Report mailed May 28, 2020, in connection with European Patent Application No. 19218935.5, filed Dec. 12, 2019, 11 pgs.

International Search Report and Written Opinion mailed Feb. 15, 2021, in connection with International Patent Application No. PCT/EP2020/087128, filed Dec. 18, 2020, 14 pgs.

* cited by examiner

METAL ALLOY

CROSS-REFERENCE TO RELATED APPLICATIONS

This application is a national stage of International Patent Application Serial No. PCT/EP2020/087128, filed Dec. 18, 2020, which claims priority to European Patent Application No. 19218935.5, filed Dec. 20, 2019; the disclosures of all are incorporated herein by reference in their entirety.

TECHNICAL FIELD

The present invention relates to an electron conducting metal alloy, a method for coating a metal alloy, and a method for manufacturing a metal alloy; and in particular to a metal alloy suitable as an anode material in the aluminium process industry.

BACKGROUND

One of the biggest challenges in the aluminium process industry is to replace consumable carbon anodes with a material that is not consumable and therefore does not release $CO_2$ or $CF_4$ emissions during electrolysis. This challenge has been ongoing for over a century, ever since the initial developments of Charles Hall and Paul Heroult, and it has become even more acute now because of current environmental and climate change problems.

Numerous anode materials have been trialled over the last 120 years, including metals, ceramics and ceramic-metal composites, otherwise known as cermets. The state-of-the-art of these non-consumable anode materials has been summarised in a recent 2018 review article (Padamata S. K et al, "Progress of Inert Anodes in Aluminium Industry: Review", J. Sib. Fed. Univ. Chem., 2018, 11-1, 18-30).

One of the most important criteria for new materials is the long-term resistance against excessive oxidation and fluoridation, since the anode needs to survive at ≈975° C. immersed in molten cryolite salt ($Na_3AlF_6$, plus dissolved alumina $Al_2O_3$ and other additives like $CaF_2$, NaF, KF and $AlF_3$) while also evolving oxygen gas at its surface.

Most materials do not survive these harsh process conditions and are destructively corroded in a short period of time, rendering the anode useless. Typical signs of cryolite corrosion at the anode would include cracking, spalling, flaking, pulverisation, pore formation and dissolution.

Another criteria for a successful anode are electrical conductivity, which needs to be as high as possible (preferably>100 S/cm). Thermal shock resistance and high-temperature creep resistance are also crucial for the initial contact and long-duration exposure to molten cryolite, respectively.

While some progress has been made developing and trialling non-consumable anode materials in laboratories, there are still no fully commercialised solutions in industrial operation today. Anode materials, based on an all-ceramic solution, suffer from low electrical conductivity, poor thermal shock resistance and cracking. Anodes with extrinsic ceramic coatings applied on to the surface of another object generally spall and crack off with time. Anodes made by consolidating ceramic and metallic powders into a solid composite fare better and have higher conductivities, but cryolite corrosion can often degrade the metallic binder holding the composite together.

Therefore, there is a need in the art today for improved materials suitable as anode material in the aluminium process industry.

SUMMARY

An object of the invention is to provide a metal alloy, in particular a metal alloy suitable for use as an anode material in the aluminium process industry. This object of the invention, as well as other objects apparent to a person skilled in the art after having studied the description below, are accomplished by a conductive multicomponent multiphase metal alloy having the following composition (in atom-%)

at least three elements selected from the list consisting of Sn, Nb, Ta, B, Cr, Ce, Fe, La, Nd, Sm, Gd, Ti, Zr, Mn, Hf, Si, P, Al, Y and V in a total amount of at least 30-65 atom-%; Ni, in a total amount of at least 35 atom-%.

The metal alloy may comprise at least three distinct crystalline phases, at least one phase may be an intermetallic phase.

The inventive metal alloy has proven to be a highly promising material for use as an anode material in the aluminium process industry, and in particular as an anode material in the Hall-Heroult process.

The metal alloy of the invention provides a combination of properties that makes it suitable for use in very demanding environments and for example as an anode material during the Hall-Heroult process. In particular, the inventors have realized that the inventive metal alloy is capable of forming an intrinsic and highly adherent mineral coating, upon contact with oxygen gas and molten salt solution, such as molten salt solution comprising molten cryolite, and optionally also additives such as $CaF_2$, NaF, KF and $AlF_3$. The contact is preferably achieved by submerging the alloy into a molten salt bath for a period of time sufficient to form said coating, i.e. for at least 30 minutes, such as of at least 1 hour, preferably at least 2 hours. This forms an intrinsic coating which has proven to be highly resistant towards said molten salt solution, and in particular against molten cryolite. Furthermore, the intrinsic coating is highly adherent to the metal alloy substrate, which alleviates or even avoids the problems associated with spalling and cracking known from prior art solutions involving extrinsic coating layers. Furthermore, the intrinsic coating is self-healing in the molten salt solution, since the exposure of the metal alloy to oxygen and the molten salt solution forms the intrinsic coating layer.

Herein, the term "multicomponent" refers to that the metal alloy comprises at least 4 elements.

Herein, the term "multiphase" refers to that the metal alloy comprises at least three distinct crystalline phases, at least at temperatures below its melting point.

Herein, the term "intrinsic coating" refers to a coating which is able to naturally form on a substrate under certain environmental conditions and displays which self-healing properties. For example, stainless steel contains >12% chromium which, upon exposure to air, is able to naturally form a thin coating of chromium oxide ($Cr_2O_3$) protecting the iron below from corrosion. When the chromium oxide coating is scratched or removed, the coating will immediately re-form and self-heal because chromium is contained within the alloy and is surface-active. This makes stainless steel an alloy with a self-healing intrinsic coating. In a similar manner, the metal alloy of the present invention forms a self-healing coating when in contact with a molten salt comprising fluoride, such as cryolite, and oxygen.

The opposite of an intrinsic coating is an extrinsic coating. These are coatings of a different material that are applied onto the surface of a substrate. For example, galvanised steel has an extrinsic coating of zinc applied to the iron substrate. In this case, if the zinc coating is scratched, cracked or removed from the surface, fresh iron is revealed, and corrosion will proceed unabated. Therefore, extrinsic coatings are less reliable and more prone to corrosion than intrinsic coatings, but often cheaper. Extrinsic coatings can be applied in various ways, such as hot dipping, painting, plasma spraying, cold spraying, solgel coating, sputtering, electroplating, electroless plating etc.

The intrinsic coating layer has furthermore proven to be electrically conducting, which is yet another requirement for use of the alloy as an anode material. The metal alloy of course provides an excellent bulk conductivity, which makes the alloy highly suitable as an anode material.

By providing a metal alloy material, which upon contact with the molten salt solution forms an adherent intrinsic coating layer on the alloy, the ductility of the metal alloy can be combined with the chemical resistance of the coating layer, thereby forming a coated metal alloy that has a good thermal shock resistance. Thus, the alloy is less likely to crack upon immersion in a molten salt bath.

The metal alloy has furthermore shown to have an excellent resistance to creep for extended periods of time during high temperatures in molten salt solution. High-temperature testing at 975° C. for >1000 hours led to no slumping or shape change due to creep.

The intrinsic coating layer formed on the inventive metal alloy upon contact with oxygen and a molten salt, preferably a molten salt comprising fluoride, e.g. cryolite may comprise at least one oxide, fluoride or oxyfluoride selected from the list consisting of Zircon($(Zr,Hf)SiO_4$); Hafnon ($(Hf,Zr)SiO_4$); Stetindite ($(Ce,REE)SiO_4$); Xenotime ($(Y,Ce,La,REE)PO_4$); Wakefieldite ($(Ce,La,Y,Nd,Pb)VO_4$); Schiavinatoite ($(Nb,Ta)BO_4$); Béhierite ($(Ta,Nb)BO_4$); Ixiolite($(Ta,Nb,Sn,Fe,Mn,Zr,Hf,Ti)_4O_8$); Wodginite ($(Mn,Ti,Sn,Fe,Ce,La)(Ta,Nb)_2O_8$; Samarskite ($(Y,Fe,Mn,REE,Th,U,Ca)_2(Nb,Ta,Ti)_2O_8$); Euxenite ($(Y,Ca,Ce,La,Th,U)(Nb,Ta,Ti)_2O_6$); Polycrase ($(Y,Ca,Ce,La,Th,U)(Ti,Nb,Ta)_2O_6$); Tapiolite ($(Fe,Mn)(Ta,Nb)_2O_6$; Fersmite ($(Ca,Ce,La,Na)(Nb,Ta,Sn,Ti)_2O_5F$); Aeschynite ($(Ce,Ca,Fe,Th,Nd,Y)(Ti,Nb)_2O_6$); Fluornatromicrolite ($(Na,Ca,Ce,La,REE,U,Pb)_2(Ta,Nb,Sn,Ti)_2O_6F$); Zirconolite ($(Ca,Y,REE)Zr(Ti,Nb,AI,Fe)_2O_6F$); Kobeite ($(REE,Fe,U)_3Zr(Ti,Nb)_3O_{12}$); Gagarinite ($Na(Ca,Ce,La,Y,REE)_2F_6$);Davidite ($(La,Ce,Ca)(Y,U)(Ti,Fe)_{20}O_{38}$); Fluocerite ($(Ce,La,Y,REE,Ca)F_3$); Simpsonite ($Al_4(Ta,Nb,Sn,Ti)_3O_{13}$); Albite ($(Na,Ca)AlSi_3O_8$); Wöhlerite ($NaCa_2(Zr,Hf,Nb,Ta,Ti)Si_2O_7F_2$); Nioboholtite ($(Nb,Ta)Al_6BSi_3O_{18}$); Vigezzite ($(Ca,Ce,La)(Nb,Ta,Ti)_2O_6$); Loparite-Ce ($Na(Ce,La,REE)(Ti,Nb,Ta)_2O_6$); Vlasovite ($Na_2ZrSi_4O_{11}$); Normandite ($NaCa(Mn,Fe)(Ti,Nb,Ta,Zr)(Si_2O_7)OF$); Lakargiite ($Ca(Zr,Sn,Ti)O_3$); Foordite ($Sn(Nb,Ta)_2O_6$); and Ainalite ($Sn(Fe,Ta,Nb)O_2$).

The minerals above are documented and officially approved by the International Mineralogical Association (IMA).

The listed minerals can form miscible combinations and solid-solutions with each other because of their isotypic structures. For example, zircons, hafnons and stetindites are all mutually soluble; schiavinatoite and béhierite are mutually soluble; xenotimes and zircons are mutually soluble; euxenite and polycrase are mutually soluble; fersmite and aeschynite are mutually soluble etc. Consequently, it is possible to create multicomponent alloys that form a mixture of these minerals at the surface of the metal alloy, and not only one mineral type. This provides a significant opportunity to tune the mineral layer on the outside, by tuning the metallic alloy chemistry on the inside.

The elements Na, Ca, Al, O and F are typically absorbed into the metal alloy from the molten salt bath during processing, and thus do not need to be present in the alloy.

By providing a metal alloy, which upon contact with oxygen and molten cryolite forms at least one intrinsic, adherent coating comprising at least one of the oxides, fluorides and oxyfluorides above, or mixtures thereof, an alloy material which forms a stable, adherent and molten salt-withstanding coating on its surface can be provided.

In fact, the above mentioned mineral(s) formed as a coating layer has proven particularly advantageous in withstanding cryolite. There are a number of known geological sites where massive cryolite deposits have been found in nature. Perhaps the most prominent sites is the Pitinga mine in Brazil in the Amazon basin (Location: 0° 45' 12.5" S, 60° 6' 5" W). This is a pegmatitic granite region, formed 1.88 billion years ago, and containing a 10 million tonne deposit of cryolite ($Na_3AlF_6$), 300 m long, 30 m thick and 250 m below the Earth's surface. Further details can be found in the following geology paper (A.C. Bastos Neto et al., "The World Class Sn, Nb, Ta, F (Y, REE, Li) Deposit and the Massive Cryolite Associated with the Albite-Enriched Facies of the Madeira A-Type Granite, Pitinga Mining District, Amazonas State, Brazil", The Canadian Mineralogist, 2009, Vol. 47, p. 1329-1357). A similar 2-billion-year-old, cryolite-rich, pegmatitic granite region has also been found at the Katugin mine (Location: 56° 16' 48" N, 119° 10' 48" E) in Eastern Siberia, Russia, as reported recently (D.P. Gladkochub et al. "The Unique Katugin Rare-Metal Deposit in Southern Siberia", Ore Geology Reviews, 2017, Vol. 91, p. 246-263). During the geological formation of the Earth, these deep cryolite deposits would have been molten for an extremely long period of time, eventually cooling and solidifying over many centuries to become part of the solid crust. The molten cryolite, at magmatic temperatures above 1000° C., would have been in direct contact with other rock minerals within the pegmatitic granite system surrounding it. Because of the very long residence times of molten magma, arguably many centuries, liquid cryolite and its associated minerals would certainly have been in equilibrium.

Hence, any associated minerals found in direct contact and equilibrium with molten cryolite must have good thermodynamic stability and longevity, otherwise they would have simply gone into solution, they would not exist as distinct minerals and would not be visible in petrographic samples in the scientific literature.

However, an electrode for aluminium production of merely said minerals would typically be hard, brittle, prone to cracking, difficult to form into shapes and have lower bulk conductivity compared to metallic alloys. Such an electrode would therefore not be commercially viable.

The present invention is based on the realization that by providing a metal alloy, which upon contact with a molten salt containing fluoride and oxygen forms an intrinsic, adherent mineral coating, the respective properties of the bulk material and the formed coating synergistically provides a material suitable for use as a metal anode in for example the Hall-Heroult process. This approach gives an excellent combination of properties, e.g.: (i) high bulk electrical conductivity for the alloy, (ii) good electrical conductivity of the external mineral layer at ≈975° C., (iii) high thermodynamic stability and slow dissolution of the mineral layer in molten cryolite, (iv) intrinsic self-healing ability to re-form the external mineral layer, (v) good resistance against attack by liquid aluminium in the cryolite bath, (vi) good thermal shock resistance, (vii) excellent creep resistance at elevated temperatures, and (viii) simple, low-cost manufacturing of the alloy in a variety of anode shapes and sizes. Another advantage of the present invention is that the use of alloying elements such as Co Cu, Zn, Mo, W, Re, Bi, Be, Mg, Ag and Platinum Group Metals (Pt, Pd, Ru, Rh, Os, Ir) can be avoided. In some examples, the metal alloy of the invention is devoid of Co Cu, Co, Zn, Mo, W, Re, Bi, Be, Mg, Ag, Pt, Pd, Ru, Rh, Os, and Ir. These elements these elements are either prohibitively expensive and/or they do not appear in the natural minerals that withstand cryolite.

It is contemplated that the conductivity of the intrinsic coating layer can be at least partly attributed to the non-integral mixed valency of the minerals in the mineral coating, and the heavy doping. According to Verwey's rule, compounds with mixed valency have a large effect on electron transfer and electron hopping. This gives the opportunity to use doping and the mixed valency of elements, like Sn, Fe, Mn, Cr etc, to increase the electronic conductivity of the mineral coatings, further improving the anode's current-carrying properties in a Hall-Heroult cell. The mixed valency of mineral coatings is also manifested in the different surface colours (green, blue, grey, brown) found in the invented alloys after cryolite/air exposure.

The mineral layers formed are reasonably smooth, approximately 10-100 microns thick, highly adherent to the base alloy underneath, typically coloured, electronically conductive and, most importantly, stable.

Herein, the term "conductive metal alloy" refers to a metal alloy having an electrical conductivity of at least 100 S/cm.

Herein, the term "conductive mineral coating" refers to a mineral coating having an electrical conductivity of at least 10 S/cm.

Another realization of the inventors of the present invention is that a coating layer as described above can be obtained by providing a metal alloy comprising at least three high field strength element (HFSE). Herein, high field strength element is intended to denote chemical elements that have small ions and high charge, as calculated by a z/r ratio (where z is ionic charge and r is ionic radius). Herein, the r values are as defined by R. D. Shannon (1976) "Revised effective ionic radii and systematic studies of interatomic distances in halides and chalcogenides". Acta Crystallogr A. 32 (5): 751-767". Because of their high z/r ratio (>2) and intense electrostatic fields, HFSEs are considered immobile and incompatible. It is contemplated that these properties prevent the alloy comprising the high field strength elements from dissolving in the molten cryolite. The elements with the highest z/r ratios include: Sn, Nb, Ta, Zr, Hf, Sn, Ce, La, Y, Th, U, Ti, Pb, Mn, Fe, V, Cr, P, Si, B, Al and rare earth elements (REEs), such as Nd, Sm, Gd. Thus, the term "HFSE" used herein, refers to Sn, Nb, Ta, Zr, Hf, Sn, Ce, La, Y, Th, U, Ti, Pb, Mn, Fe, V, Cr, P, Si, B, Nd, Sm and Gd. As shown by the minerals found in e.g. the Pitinga mine, these elements form stable minerals in association with cryolite. U, Th and Pb have other disadvantageous properties (such as radioactivity and toxicity) that make them less relevant for the alloy of the present invention. Such a metal alloy will, upon submersion into a molten salt comprising fluoride, such as molten cryolite, react with oxygen and fluoride present in the molten salt and form an intrinsic coating layer, preferably having a thickness in the range of from 10 to 100 μm on the surface of the metal alloy. The coating layer will comprise at least one of the above described IMA approved minerals. See FIG. 7 for facilitated understanding.

In some examples, the metal alloy of the present invention consists of at least three elements selected from the list consisting Sn, Nb, Ta, B, Cr, Ce, Fe, La, Nd, Sm, Gd, Ti, Zr, Mn, Hf, Si, P, Al, Y and V; and Ni (and optionally naturally occurring impurities). Thus, Ni may in some examples represent a balance of the metal alloy, optionally along with naturally occurring impurities.

Additionally, the metal alloy may comprise small amount of Ca, such as less than 5 atom-%, preferably less than 4 atom-%.

The amount of natural occurring impurities in the metal alloy is typically less than 0.4 atom-%, such as less than 0.3 atom-%, preferably less than 0.2 atom-%. The natural occurring impurities are impurities present in the raw materials. Such impurities are in principle impossible to avoid in commercial alloys.

Thus, the present invention provides an alloy comprising at least three HFSE elements. Preferably, the metal alloy includes at least three HFSE elements, such as at least 4 HFSE elements, such as at least 5 HFSE elements, preferably between 4 and 15 HFSE elements, or between 6 and 15 HFSE elements, such as between 6 and 14 HFSE elements. The total amount of HFSE elements in the metal alloy is typically at least 20 atom-%, such as at least 30 atom-%, preferably at least 32 atom-%, the balance being Ni. It is contemplated that the stability of the metal alloys can be attributed to both the high compositional entropy of a metal alloy comprising a plurality of elements, but also by the provision of a plurality of HFSE in the metal alloy. By providing a metal alloy comprising HFSE, the above-described mineral coatings can be formed on the metal alloy surface, upon contact with oxygen and molten fluoride salt. In some examples, the metal alloy consists of HFSE elements and a balance Ni in an amount of at least 35 atom-%. HSFE elements refers to Sn, Nb, Ta, B, Cr, Ce, Fe, La, Nd, Sm, Gd, Ti, Zr, Mn, Hf, Si, P, Al, Y and V.

The metal alloy of the present invention may comprise a total amount of 20-65 atom-% of Sn, Nb, Ta, B, Cr, Ce, Fe, La, Nd, Sm, Gd, Ti, Zr, Mn, Hf, Si, P, Al, Y and V, such as a total amount of 20-50 atom-% of Sn, Nb, Ta, B, Cr, Ce, Fe, La, Nd, Sm, Gd, Ti, Zr, Mn, Hf, Si, P, Al, Y and V, such as 30-50 atom-% of Sn, Nb, Ta, B, Cr, Ce, Fe, La, Nd, Sm, Gd, Ti, Zr, Mn, Hf, Si, P, Al, Y and V. The remaining balance comprises a majority of Ni. The balance may be Ni and optionally naturally occurring impurities.

Ni has proven to be an excellent base element for the metal alloy, owing to its high melting point and ability to form various intermetallic phases with the HFSE elements of the invention. Advantageously, the inventors have found that at least 35 atom-% of the metal alloy can be Ni, such as 35-70 atom-%, preferably 40-70 atom-%, more preferably 40-60 atom-%. Ni is cheaper than many of the above mentioned HFSE elements. Nickel is furthermore advantageous in that it has a high melting point and in that it is capable of forming intermetallics with several of the above HFSE.

The metal alloy of the present invention comprise at least three distinct crystallographic phases, of which at least one may be an intermetallic phase. Herein, an intermetallic phase is defined as a solid phase involving two or more metallic or semi-metallic elements with an ordered crystal structure and a well-defined and fixed stoichiometry. A solid solution, on the other hand, is a solid phase in which elements are randomly positioned and interchangeable within the crystal lattice, thereby forming one unique phase. The phases can be studied and compositionally analysed on a cross-section of the material using e.g. SEM-EDS.

The metal alloy of the invention thus differs from high entropy alloys for example in that high entropy alloys generally form only a solid solution phase and no intermetallics.

In examples of the metal alloy of the present invention, at least three phases form, of which one may be an intermetallic phase. Examples of intermetallic phases formed include $Ni_3Sn$, $Nb_3B_2$ and $(Ce,La)Ni_5Sn$, ZrSi, $Cr_2B_2$, $ZrNi_2Sn$.

The metal alloy of the present invention is devoid of $Fe_2NiO_4$, which is not present in the metal alloy of the present invention, neither in the bulk of the material or at its surface.

The other two phases may be two other intermetallic phases, different from each other and the first intermetallic, one intermetallic phase different from the first intermetallic and a solid solution, or two different solid solution phases. The solid solution phase can include, for example, Ni—Cr—Nb—Sn—Ta—Fe—Mn—Ti.

The rare earth elements relevant for the present invention include Ce, La, Y, Nd, Sm and Gd.

In embodiments, the metal alloy comprises or consists (in atom-%) of 1-25 Sn; 0.1-20 Nb and/or Ta; 10-60 of at least one additional HFSE element selected from the list consisting of Sn, Nb, Ta, B, Cr, Ce, Fe, La, Nd, Sm, Gd, Ti, Zr, Mn, Hf, Si, P, Al and V; and a balance of at least 35 atom-% Ni. Such metal alloy will, upon contact with oxygen and a molten salt comprising fluoride, form an adherent intrinsic coating comprising at least one of the above-described, IMA approved minerals. Preferably, the metal alloy comprises at least 20 atom-% HFSE, such as at least 30 atom-%, preferably at least 40 atom-%, more preferably at least 45 atom-%.

Ta and Nb are very similar elements and can in principle be interchanged in many crystal structures. Typically, they may be provided from the same master alloy. Thus, a total amount of Ta and/or Nb refers to a total amount of Ta+Nb.

In embodiments, the metal alloy comprises the following composition (in atom-%)

Sn in a total amount of 1-20

Nb and/or Ta in a total amount of 0.5-10 and, one or several elements selected from the consisting of B, Cr, Ce, Fe, La, Nd, Sm, Gd, Ti, Zr, Mn, Hf, Si, P, Al, Y and V in a total amount of from 10-50 the balance being Ni, in a total amount of at least 35 atom-% and optionally other naturally occurring impurities. Sn and Nb/Ta has proven to be particularly preferred HFSEs owing to their ability to form solid solutions and intermetallic with the balance elements, and in particular with Ni.

In some embodiments, the metal alloy comprises at least 4 elements selected from the list consisting of Sn, Nb, Ta, B, Cr, Ce, Fe, La, Nd, Sm, Gd, Ti, Zr, Mn, Hf, Si, P, Al, Y and V, such as at least 5 elements selected from the list consisting of Sn, Nb, Ta, B, Cr, Ce, Fe, La, Nd, Sm, Gd, Ti, Zr, Mn, Hf, Si, P, Al, Y and V, preferably at least 6 elements selected from the list consisting of Sn, Nb, Ta, B, Cr, Ce, Fe, La, Nd, Sm, Gd, Ti, Zr, Mn, Hf, Si, P, Al, Y and V, or at least 7 elements selected from the list consisting of Sn, Nb, Ta, B, Cr, Ce, Fe, La, Nd, Sm, Gd, Ti, Zr, Mn, Hf, Si, P, Al, Y and V, or at least 8 elements selected from the list consisting of Sn, Nb, Ta, B, Cr, Ce, Fe, La, Nd, Sm, Gd, Ti, Zr, Mn, Hf, Si, P, Al, Y and V.

In some embodiments, the metal alloy comprises 5-12 elements selected from the list consisting Sn, Nb, Ta, B, Cr, Ce, Fe, La, Nd, Sm, Gd, Ti, Zr, Mn, Hf, Si, P, Al, Y and V, such as 6-12 metal alloys selected from the list consisting Sn, Nb, Ta, B, Cr, Ce, Fe, La, Nd, Sm, Gd, Ti, Zr, Mn, Hf, Si, P, Al, Y and V.

In some embodiments, the metal alloy comprises 5-8 elements selected from the list consisting of Sn, Nb, Ta, B, Cr, Ce, Fe, La, Nd, Sm, Gd, Ti, Zr, Mn, Hf, Si, P, Al, Y and V. Thus, a metal alloy comprising 5-8 HFSE can be provided, which has shown particularly advantageous in terms of stability and ability to form the above described mineral coatings.

In some embodiments, said metal alloy consists of a total of 4 to 15 elements.

In some embodiments, the metal alloy comprises Cr in a total amount of 3-20 atom-% Cr, such as 10-20 atom-% or 5-15 atom-%, preferably 15-20 atom-% or 1-10 atom-%, such 3-8 atom-%. Addition of Cr in an amount of 3-20 atom-% has proven particularly advantageous. Cr forms solid solution with e.g. Ni. The formation of solid solution phases and intermetallic phases is contemplated to increase the stability of the metal alloy. Chromium is further contemplated to improve the corrosion resistance of the alloy.

In some embodiments, the metal alloy comprises Mn in a total amount of 1-10 atom-%., such as 1-5 atom-%, preferably 1-4 atom-%. It is contemplated that the addition of Mn increases the heat resistance of the alloy.

In some embodiments, the metal alloy comprises Fe in a total amount of 0.1-5 atom-%, such as in the range of 0.1-3 atom-%, preferably in the range of 0.4-1.2 atom-%.

In some embodiments, the metal alloy comprises Ti in a total amount of 0.1-5 atom-%, such as 0.1-3 atom-%, preferably in the range of 0.4-1.2 atom-%.

In some embodiments, the total amount of Sn is in the range of 1-25 atom-%, such as 1-20 atom-%, preferably 5-15 atom-% or 10-20 atom-%. Sn advantageously forms intermetallic phases with Ni, such as $Ni_3Sn$.

In some embodiments, the total amount of Nb and/or Ta in the metal alloy is in the range of from 0.1-10 atom-%, such as 0.5-10 atom-%, preferably 0.5-1.5 atom-% or 2-7 atom-%. Nb and Ta advantageously forms intermetallics with B, such as $Nb_3B_2$ and $Ta_3B_2$.

In some examples, the metal alloy comprises no more than 15 atom-% Zr, such as 7-12 atom-% Zr.

In some embodiments the metal alloy comprises no more than 10 atom-% B, such as 0.3-4 atom-% B. B advantageously forms intermetallics with Nb and Ta, such as $Nb_3B_2$ and $Ta_3B_2$.

In some embodiments the metal alloy comprises no more than 10 atom-% Ce and/ or Le such as 0.3-8 atom-% Ce and/or La. Ce and La are typically provided from the same master alloy ("mischmetal"), which contains both Ce and La. Ce and La can form intermetallics with e.g. Ni. Thus, a total amount of Ce and/or La refers to a total amount of Ce+La.

In some embodiments the metal alloy comprises no more than 15 atom-% Si, such as 5-14 atom-% Si.

In some embodiments the metal alloy comprises no more than 5 atom-% Gd such as 0.5-2 atom-% Gd.

In some embodiments the metal alloy comprises no more than 5 atom-% Nd, such as 0.1-1 atom-% Nd.

In some embodiments the metal alloy comprises less than 10 atom-% Sm, such as in the range of 0.1-10 atom-% Sm. Preferably, the metal alloy comprises less than 10 atom-% of a total amount of Sm and Y.

In some embodiments the metal alloy comprises less than 10 atom-% Hf, such as 0.1-10 atom-% Hf, preferably 0.5-5 atom-% Hf.

In some embodiments the metal alloy comprises less than 10 atom-% P, such as 0.1-10 atom-% P, preferably 0.5-5 atom-% P.

In some embodiments the metal alloy comprises less than 10 atom-% Al, such as 0.1-10 atom-% Al, preferably 0.5-5 atom-% Al.

In some embodiments the metal alloy comprises less than 10 atom-% V, such as 0.1-10 atom-% V, preferably 0.5-5 atom-% V.

In some embodiments, the balance is Ni, and optionally naturally occurring impurities. Ni has proven to be a particularly advantageous in alloying with HFSE elements. Ni forms solid solutions and intermetallics with HFSE. Ni also increases the ductility of the metal alloy, as well as the corrosion resistance. The amount of Ni in the metal alloy may be in the range of 40-70 atom-%, such as 45-60 atom-%. All metal alloy compositions mentioned herein may have Ni as a balance, in an amount of at least 35 atom-%, and optionally other naturally occurring impurities.

In some embodiments, the metal alloy has, or consists of, the following composition (in atom-% of the metal alloy)

| | |
|---|---|
| Ni | >35, and |
| Cr | 1-25 |
| Mn | 1-10 |
| Nb and/or Ta | 0.1-10 |
| Fe | 0.1-5 |
| Ti | 0.1-5 |
| Sn | 1-20 |

in a total amount of Ni, Cr, Mn, Nb, Ta, Fe, Ti, Sn of at least 20;

and, optionally at least one element selected from,

| | |
|---|---|
| Zr | ≤15 |
| B | ≤10 |
| Si | ≤15 |
| Ce and/or La | ≤10 |
| Gd | ≤5 |
| Nd | ≤5 |
| Sm and/or Y | ≤5 |
| Hf | ≤10 |
| P | ≤10 |
| Al | ≤10 |
| V | ≤10 |
| Ca | ≤10 |

in a total amount of Zr, B, Si, Ce, La, Gd, Nd, Sm, Y, Hf, P, Al, V, Ca of no more than 45. The balance may be Ni.

Such alloy has proven withstand molten cryolite and oxygen for a period of over 1000 hours, without suffering from major corrosion or sample deformation. Furthermore, during submersion into molten cryolite, the metal alloy formed an adherent, intrinsic coating comprising at least one of the IMA approved minerals discussed above, or a mixture of at least two such minerals. The coating is well adherent and could not be removed manually. No signs of spalling of the coating was present. The metal alloy comprises at least one intermetallic, such as $Ni_3Sn$, $Nb_3B_2$ and $(Ce,La)Ni_5Sn$, ZrSi, $Cr_2B_2$, $ZrNi_2Sn$. The optional elements may account for less than 30 atom-%, such as for 2-25 atom-%, preferably 3-24 atom-%.

In some embodiments, the metal alloy has the following composition, or consists of the following composition, (in atom-% of the metal alloy)

| | |
|---|---|
| Ni | 45-70, |
| Cr | 3-20 |
| Mn | 1-5 |
| Nb and/or Ta | 0.5-10 |
| Fe | 0.4-1.2 |
| Ti | 0.4-1.2 |
| Sn | 2-18 |

in a total amount of Ni, Cr, Mn, Nb, Ta, Fe, Ti, Sn of at least 20;

and, optionally,

| | |
|---|---|
| Zr | 7-12 |
| B | 0.3-4 |
| Si | 5-14 |
| Ce and/or La | 0.3-8 |
| Gd | 0.5-2 |
| Nd | 0.1-1 |
| Sm and/or Y | 0.1-10 |
| Hf | 0.1-10 |
| P | 0.1-10 |
| Al | 0.1-10 |
| V | 0.1-10; |

in a total amount of Zr, B, Si, Ce, La, Gd, Nd, Sm, Y, Hf, P, Al, V, Ca of no more than 30. The balance may be Ni, and optionally other naturally occurring impurities. Preferably, the metal alloy comprises at least one of the optional elements, such as at least one element selected from Zr, Si, B, Ce and/or La, Nd, or Gd. The metal alloy may also comprise 2 or more of the optional elements, such as 3 or more, or 4 or more. The total amount of optional elements may be in the range of 2-25 atom-%.

In some embodiments, the metal alloy comprises, or consists of, (in atom-% of the metal alloy)

| | |
|---|---|
| Ni | 53-63; and |
| Cr | 10-25, such as 15-20 |
| Mn | 1-10, such as 1-5 |
| Nb and/or Ta | 0.1-5, such as 0.1-1.5 |
| Fe | 0.1-5, such as 0.1-1.5 |
| Ti | 0.1-5, such as 0.1-1.5 |
| Zr | 5-15, such as 7-12 |
| Sn | 5-15, such as 7-12 |
| B | 0.1-3, such as 0.3-2 |

in a total amount of Cr, Mn, Nb, Ta, Fe, Ti, Zr, Sn and B of at least 37. The balance may be Ni.

Thus, the metal alloy comprises no more than 10 atom-% of further elements, such as the optional elements listed above.

The metal alloy will, upon contact with a molten salt comprising fluoride and oxygen, form an adherent intrinsic coating comprising zirconolite, schiavinatoite, ixiolite and kobeite. The metal alloy is capable of withstanding submersion into molten cryolite for at least 1000 hours without major corrosion and without sample deformation. The metal alloy may comprise at least a solid solution of Ni—Cr—Sn with small additions of Nb, Ta, Zr, Fe, Mn, Ti. At least one intermetallic phase will form in the metal alloy, such as $Cr_2B$, $Nb_3B_2$, $ZrNi_5$ and $ZrNi_2Sn$.

In some embodiments the metal alloy comprises or consists of (in atom-% of the metal alloy)

| | |
|---|---|
| Cr | 15-20 |
| Mn | 1-5 |
| Nb and/or Ta | 0.1-1.5 |
| Fe | 0.1-1.5 |
| Ti | 0.1-1.5 |
| Zr | 5-15 |
| Sn | 5-15 |
| B | 0.3-2 |

the balance being Ni in an amount of 53-63 and optionally other naturally occurring impurities. The metal alloy will, upon contact with a molten salt comprising fluoride and oxygen, form an adherent intrinsic coating comprising zirconolite, schiavinatoite, ixiolite and kobeite. The metal alloy is capable of withstanding submersion into molten cryolite for att least 1000 hours without major corrosion and without sample deformation. The metal alloy may comprise at least a solid solution of Ni—Cr—Sn with small additions of Nb, Ta, Zr, Fe, Mn, Ti. At least one intermetallic phase will form in the metal alloy, such as $Cr_2B$, $Nb_3B_2$, $ZrNi_5$ and $ZrNi_2Sn$.

In some embodiments, the metal alloy comprises, or consists of, (in atom-% of the metal alloy)

| | |
|---|---|
| Ni | 47-57; and |
| Cr | 10-25, such as 10-20 |
| Mn | 1-5, such as 2-4 |
| Nb and/or Ta | 0.1-5, such as 0.1-1.5 |
| Fe | 0.1-5, such as 0.1-1.5 |
| Ti | 0.1-5, such as 0.1-1.5 |
| Zr | 5-15, such as 7-12 |
| Sn | 1-5, such as 2-4 |
| Si | 5-15, such as 7-12 |
| Ce and/or La | 0.1-3, such as 0.1-1.5 |
| Gd | 0.5-2, such as 0.7-1.5 |
| Nd | 0.1-2, such as 0.1-0.5 |

in a total amount of Cr, Mn, Nb and Ta, Fe, Zr, Sn, Si, Ce, La, Gd and Nd of at least 43. The balance may be Ni and optionally other naturally occurring impurities.

Thus, the metal alloy comprises no more than 10 atom-% of further elements, such as the of optional elements listed above.

The metal alloy will, upon contact with a molten salt comprising fluoride and oxygen, form an adherent intrinsic coating comprising zirconolite, euxenite, gagarinite, ixiolite and tapiolite, such as numerous phases and solid-solutions of zirconolite, euxenite, gagarinite, ixiolite and tapiolite. The metal alloy is capable of withstanding submersion into molten cryolite for att least 1000 hours without major corrosion and without sample deformation. The bulk metal alloy may comprise a solid solution of Ni—Cr—Nb—Sn with small additions of Zr, Ta, Fe, Mn, Ti, Si. The presence of specific phases in the alloy can be analysed with e.g. SEM-EDS.

In some embodiments, the metal alloy comprises or consists of (in atom-% of the metal alloy)

| | |
|---|---|
| Cr | 10-20 |
| Mn | 1-5 |
| Nb and/or Ta | 0.1-1.5 |
| Fe | 0.1-1.5 |
| Ti | 0.1-1.5 |
| Zr | 7-12 |
| Sn | 1-5 |

-continued

| | |
|---|---|
| Si | 5-15 |
| Ce and/or La | 0.1-1.5 |
| Gd | 0.5-2 |
| Nd | 0.1-2 |

the balance being Ni in an amount of 47-57, and optionally other naturally occurring impurities. The amount of Cr may be 14-18, such as 15-17.

The metal alloy will, upon contact with a molten salt comprising fluoride and oxygen, form an adherent intrinsic coating comprising zirconolite, euxenite, gagarinite, ixiolite and tapiolite, such as numerous phases and solid-solutions of zirconolite, euxenite, gagarinite, ixiolite and tapiolite. The metal alloy is capable of withstanding submersion into molten cryolite for att least 1000 hours without major corrosion and without sample deformation. The bulk metal alloy may additionally comprise a solid solution of Ni—Cr—Nb—Sn with small additions of Zr, Ta, Fe, Mn, Ti, Si. The presence of specific phases in the alloy can be analysed with e.g. SEM-EDS.

In some embodiments, the metal alloy comprises, or consists of (in atom-% of the metal alloy)

| | |
|---|---|
| Ni | 55-65; and |
| Cr | 3-20, such as 5-15 |
| Mn | 1-7, such as 1-5 |
| Nb and/or Ta | 3-12, such as 5-10 |
| Fe | 0.1-5, such as 0.5-1.5 |
| B | 1-10, such as 1-5 |
| Sn | 8-22, such as 10-20 |
| Ti | 0.1-5, such as 0.1-2 |

in a total amount Cr, Mn, Nb, Ta, Fe, B, Sn, Ti of at least 45. The balance may be Ni and optionally other naturally occurring impurities.

Thus, the metal alloy comprises no more than 10 atom-% of further elements, such as of the optional elements listed above.

Preferably, the metal alloy may comprise or consist of

| | |
|---|---|
| Cr | 5-15 |
| Mn | 1-5 |
| Nb and/or Ta | 5-10 |
| Fe | 0.1-5 |
| B | 1-5 |
| Sn | 10-20 |
| Ti | 0.1-5 |

the balance being Ni, in an amount of 55-65, and optionally other naturally occurring impurities.

The metal alloy will, upon contact with a molten salt comprising fluoride and oxygen, form an adherent intrinsic coating comprising schiavinatoite, béhierite, ixiolite, tapiolite, and fersmite, such as phases and solid-solutions of schiavinatoite, béhierite, ixiolite, tapiolite, and fersmite. The alloy is a multicomponent metallic alloy comprising three distinct equilibrium phases, as specified by SEM-EDS: i) Solid solution of Ni—Cr—Nb, with small additions of Ta, Fe, Mn, Ti, Sn with a volume fraction of approximately 45 vol %; ii) Intermetallic of $Ni_3Sn$, with small additions of Nb, Ta, Fe, Mn, Ti with a volume fraction of approximately 45 vol %; iii) Intermetallic of $Nb_3B_2$, with small additions of Ta, Cr, Ti, Ni, with a volume fraction of approximately 10 vol %. In some embodiments the metal alloy comprises (in atom-% of the metal alloy)

| | |
|---|---|
| Ni | 63-73; and |
| Cr | 1-15, such as 1-10 |
| Mn | 1-5, such as 1.5-4 |
| Nb and/or Ta | 0.1-10, such as 2-6- |
| Ce and/or La | 1-10, such as 3-7 |
| Fe | 0.1-5, such as 0.1-1.5 |
| Sn | 8-22, such as 10-20 |
| Ti | 0.1-5 such as 0.1-1.5 |

in a total amount of Cr, Mn, Nb, Ta, Ce, La, Fe, Sn, Ti of at least 27. The balance may be Ni and optionally other naturally occurring impurities.

Thus, the metal alloy comprises no more than 10 atom-% of further elements, such as of the optional elements listed above.

Preferably, the metal alloy comprises or consists of (in atom-% of the metal alloy)

| | |
|---|---|
| Cr | 1-10 |
| Mn | 1-5 |
| Nb and/or Ta | 0.1-10 |
| Ce and/or La | 1-10 |
| Fe | 0.1-5 |
| Sn | 8-22 |
| Ti | 0.1-5 |

the balance being Ni and optionally other naturally occurring impurities.

Ce and La are typically provided from the same master-alloy which contains a mixture of Ce and La.

The metal alloy will, upon contact with a molten salt comprising fluoride and oxygen, form an adherent intrinsic coating comprising of wodginite, aeschynite, ixiolite, tapiolite and fersmite, such as numerous phases wodginite, aeschynite, ixiolite, tapiolite and fersmite. The alloy is a multicomponent metallic alloy comprising three distinct equilibrium phases, as specified by SEM-EDS. i) solid solution of Ni—Cr—Nb, with small additions of Ta, Fe, Mn, Ti, Sn with a volume fraction of approximately 35 vol-%; ii) Intermetallic of $Ni_3Sn$, with small additions of Nb, Ta, Fe, Mn, Ti, with a volume fraction of approximately 35 vol-%; iii) intermetallic of (Ce, La)$Ni_5Sn$, with small additions of Ta, Cr, Ti, Ni, with a volume fraction of approximately 30 vol-%.

In some embodiments, the metal alloy has a compositional entropy of mixing $S_{mix}$ of at least 1.0, as calculated by formula 1. It is contemplated that the metal alloy is thermodynamically stabilized by its entropy of mixing $S_{mix}$. The entropy of mixing of an alloy can be approximated by the following formula $$S_{mix}=-R\Sigma c_i \times ln(c_i) \quad \text{(Formula 1)}$$

where $S_{mix}$ is the compositional entropy of mixing, R is the gas constant, and $c_i$ is the molar content of the ith component. In some examples, the entropy of mixing is in the range of 1.0 R-1.5 R, such as in the range of 1.1 R-1.5 R. High entropy alloys typically exhibits a $S_{mix}$ of at least 1.5 R. It is contemplated that a compositional entropy in the range of 1.0R-1.5R allows for the formation of a stable metal alloy capable of forming at least on crystalline phase being an intermetallic phase.

In some embodiments, said metal alloy is adapted to form, upon contact with oxygen and a molten salt comprising fluoride, an intrinsic surface coating comprising at least one oxide, fluoride or oxyfluoride selected from the list of IMA approved minerals consisting of: Zircon((Zr,Hf)$SiO_4$); Hafnon ((Hf,Zr)$SiO_4$); Stetindite ((Ce,REE)$SiO_4$); Xenotime ((Y,Ce,La,REE)$PO_4$); Wakefieldite ((Ce,La,Y,Nd,Pb)$VO_4$); Schiavinatoite ((Nb,Ta)$BO_4$); Béhierite ((Ta,Nb)$BO_4$); Ixiolite ((Ta,Nb,Sn,Fe,Mn,Zr,Hf,Ti)$_4O_8$); Wodginite (Mn,Ti,Sn,Fe,Ce,La)(Ta,Nb)$_2O_8$; Samarskite (Y,Fe,Mn, REE,Th,U,Ca)$_2$(Nb,Ta,Ti)$_2O_8$); Euxenite ((Y, Ca, Ce, La,Th, U)(Nb,Ta,Ti)$_2O_6$); Polycrase ((Y,Ca,Ce,La,Th,U)(Ti, Nb,Ta)$_2O_6$); Tapiolite (Fe,Mn)(Ta,Nb)$_2O_6$; Fersmite ((Ca, Ce,La,Na)(Nb,Ta,Sn,Ti)$_2O_5$F); Aeschynite ((Ce,Ca,Fe,Th, Nd,Y)(Ti,Nb)$_2O_6$); Fluornatromicrolite ((Na,Ca,Ce,La, REE,U,Pb)$_2$(Ta,Nb,Sn,Ti)$_2O_6$F); Zirconolite ((Ca,Y,REE)Zr (Ti,Nb,AI,Fe)$_2O_6$F); Kobeite ((REE,Fe,U)$_3$Zr(Ti,Nb)$_3O_{12}$); Gagarinite (Na(Ca,Ce,La,Y,REE)$_2F_6$);Davidite ((La,Ce,Ca) (Y,U)(Ti,Fe)$_{20}O_{38}$); Fluocerite ((Ce,La,Y,REE,Ca)$F_3$); Simpsonite (Al$_4$(Ta,Nb,Sn,Ti)$_3O_{13}$); Albite ((Na,Ca) $AlSi_3O_8$); Wöhlerite (NaCa$_2$(Zr,Hf,Nb,Ta,Ti)$Si_2O_7F_2$); and Nioboholtite ((Nb,Ta)Al$_6$B$Si_3O_{18}$), Vigezzite ((Ca,Ce,La) (Nb,Ta,Ti)$_2O_6$); Loparite-Ce (Na(Ce,La,REE)(Ti,Nb,Ta)$_2$ $O_6$); Vlasovite (Na$_2$Zr$Si_4O_{11}$); Normandite (NaCa(Mn,Fe) (Ti,Nb,Ta,Zr)($Si_2O_7$)OF); Lakargiite (Ca(Zr,Sn,Ti)$O_3$); Foordite (Sn(Nb,Ta)$_2O_6$); Ainalite (Sn(Fe,Ta,Nb)$O_2$).

In some embodiments, the metal alloy further comprises, on at least one outer surface, an intrinsic surface coating comprising at least one oxide, fluoride or oxyfluoride selected from the list of IMA approved minerals consisting of Zircon((Zr,Hf)$SiO_4$); Hafnon ((Hf,Zr)$SiO_4$); Stetindite ((Ce,REE)$SiO_4$); Xenotime ((Y,Ce,La,REE)$PO_4$); Wakefieldite ((Ce,La,Y,Nd,Pb)$VO_4$); Schiavinatoite ((Nb,Ta) $BO_4$); Béhierite ((Ta,Nb)$BO_4$); Ixiolite ((Ta,Nb,Sn,Fe,Mn, Zr,Hf,Ti)$_4O_8$); Wodginite (Mn,Ti,Sn,Fe,Ce,La)(Ta,Nb)$_2O_8$; Samarskite (Y,Fe,Mn,REE,Th,U,Ca)$_2$(Nb,Ta,Ti)$_2O_8$); Euxenite ((Y, Ca, Ce, La,Th, U)(Nb,Ta,Ti)$_2O_6$); Polycrase ((Y, Ca,Ce,La,Th,U)(Ti,Nb,Ta)$_2O_6$); Tapiolite (Fe,Mn)(Ta,Nb)$_2$ $O_6$; Fersmite ((Ca,Ce,La,Na)(Nb,Ta,Sn,Ti)$_2O_5$F); Aeschynite ((Ce,Ca,Fe,Th,Nd,Y)(Ti,Nb)$_2O_6$); Fluornatromicrolite ((Na,Ca,Ce,La,REE,U,Pb)$_2$(Ta,Nb,Sn,Ti)$_2O_6$F); Zirconolite ((Ca,Y,REE)Zr(Ti,Nb,AI,Fe)$_2O_6$F); Kobeite ((REE,Fe,U)$_3$Zr(Ti,Nb)$_3O_{12}$); Gagarinite (Na(Ca,Ce,La,Y, REE)$_2F_6$);Davidite ((La,Ce,Ca)(Y,U)(Ti,Fe)$_{20}O_{38}$); Fluocerite ((Ce,La,Y,REE,Ca)$F_3$) ; Simpsonite (Al$_4$(Ta,Nb,Sn, Ti)$_3O_{13}$); Albite ((Na,Ca)$AlSi_3O_8$); Wöhlerite (NaCa$_2$(Zr, Hf,Nb,Ta,Ti)$Si_2O_7F_2$); and Nioboholtite ((Nb,Ta) Al$_6$B$Si_3O_{18}$), Vigezzite ((Ca,Ce,La)(Nb,Ta,Ti)$_2O_6$); , Loparite-Ce (Na(Ce,La,REE)(Ti,Nb,Ta)$_2O_6$); Vlasovite (Na$_2$Zr$Si_4O_{11}$); Normandite (NaCa(Mn,Fe)(Ti,Nb,Ta,Zr) ($Si_2O_7$)OF); Lakargiite (Ca(Zr,Sn,Ti)$O_3$); Foordite (Sn(Nb, Ta)$_2O_6$); Ainalite (Sn(Fe,Ta,Nb)O2).

The objects of the invention are also accomplished by a conductive electrode for aluminum processing, comprising the above-described metal alloy. The electrode may be an anode or a cathode. The surface of the electrode will, upon submersion into the molten cryolite bath used in the Hall-Heroult process, form an intrinsic, adherent coating comprising at least one of the above-described IMA approved minerals, or mixtures thereof. Such an anode material exhibits, e.g. i) high bulk electrical conductivity for the alloy, (ii) good electrical conductivity of the external mineral layer at ≈975° C., (iii) high thermodynamic stability and slow dissolution of the mineral layer in molten cryolite, (iv) intrinsic self-healing ability to re-form the external mineral layer, (v) good resistance against attack by liquid aluminium in the cryolite bath, (vi) good thermal shock resistance, (vii) excellent creep resistance at elevated temperatures, and (viii) simple, low-cost manufacturing of the alloy in a variety of anode shapes and sizes.

In some embodiments, the electrode comprises, on its outer surface, an intrinsic coating as described above. In addition to being formed in situ in the Hall-Heroult process, the coating can also be formed ex-situ by submerging the metal alloy into a bath comprising molten cryolite, such as a molten cryolite bath. The bath should be open to air.

The objects of the invention are also accomplished by a method for forming an intrinsic coating on a metal alloy comprising providing a metal alloy as described above;

providing a molten salt composition comprising fluoride;

submerging at least part of the metal alloy in the molten salt composition, thereby forming a mineral coating as described above on a surface of the metal alloy as described above.

The objects of the invention are also achieved by a method oxidizing a conductive electrode comprising providing a metal alloy as defined above;

providing an oxygen containing atmosphere;

heating at least part of the metal alloy in the oxygen containing atmosphere, thereby forming at least one oxide as described above on a surface of the metal alloy.

It may be advantageous to pre-oxidize the metal alloy of the electrode before using the electrode in an aluminium processing.

The objects of the invention are also achieved by a method for fluoridizing a conductive electrode comprising providing a metal alloy as defined above;

providing a fluoride containing atmosphere;

heating at least part of the metal alloy in the fluoride containing atmosphere, thereby forming at least one fluoride as described above on a surface of the metal alloy.

It may be advantageous to pre-fluoridize the metal alloy of the electrode before using the electrode in an aluminium processing.

The objects of the invention are also accomplished by a method for manufacturing a metal alloy as defined above, comprising providing Ni in an amount of at least 35-60 atom-% of the metal alloy;

providing a total of 30-65 atom-% of at least three elements selected from the list consisting of Sn, Nb, Ta, B, Cr, Ce, Fe, La, Nd, Sm, Gd, Ti, Zr, Mn, Hf, Si, P, Al and V;

melting the provided elements to form a melt;

agitating said melt;

solidifying said melt to form a metal alloy.

The amount of each element is discussed above in relation to the composition of the metal alloy.

The multicomponent metallic alloys can be a manufactured in a plurality of ways. The first step is to synthesise the alloy with the desired chemical composition. Here, pure elements or masteralloys can be utilised as the raw materials. Cleanliness of the raw materials is paramount.

A number of known methods exist for heating, mixing and melting alloys, such as vacuum induction melting (VIM), vacuum arc remelting (VAR), electroslag remelting (ESR), self-propagating high-temperature synthesis (SHS), or inert gas atomisation (IGA). Owing to the reactive nature of many of the pure HFSE constituents, the alloy synthesis should preferably be performed under an inert atmosphere, such as vacuum or low-pressure argon.

To create 3D shaped anodes for industrial scale-up, additional manufacturing steps are required. These could include casting processes like investment casting, copper-mould casting, centrifugal casting, tilt casting, counter-gravity casting, continuous casting etc. Forging, forming and rolling of cast ingots are also possibilities. In the case of powder alloy feedstock, a number of powder-metallurgy routes could be utilised, including for example 3D-printing, thermal spraying, powder sintering, metal-injection moulding, diffusion bonding, hot pressing, cladding, vapour deposition etc. And, in order to attach anodes to busbar connectors, welding methods may also be required, notably tungsten inert gas (TIG) welding or diffusion welding.

Anodes used in aluminium electrolysis can have a variety of different shapes. Currently large, metre-sized, rectangular blocks are used industrially for carbon anodes, but this should not limit the designs for new inert anodes. Other shapes may be more appropriate such as cubes, plates, sheets, cylindrical bars, rods, wires, tubes, spheres, discs or lattices. And in terms of configuration, these new inert anodes could be placed horizontally above the cathodes, or vertically next to the cathodes in alternating fashion, depending on the optimal cell design.

Surface patterning and texturing of the alloy anode is also possible, including for example arrays of holes, channels, dimples and/or protrusions to allow for preferential flow of evolving oxygen gas and/or molten salt. Since the metal alloy of the present invention forms its coating upon contact with the molten cryolite, the metal alloy of the present invention allows for the formation of the mineral coating even at surfaces that would be otherwise hard to reach.

EXAMPLES

Multicomponent metallic alloys (alloys 1-4) with a plurality of HFSEs (usually 5-8) have been produced by vacuum induction melting (VIM). Pure elements were weighed, cleaned, inductively heated, agitated and melted at >1300° C. under vacuum, and, then under low-pressure argon, poured into copper moulds for rapid freezing to achieve ingots having fine grain sizes of 1-10 microns. Alloy ingots had a typical mass of 1.5 kg and were shaped into both cylinders and blocks. These ingots were then used for cryolite testing at 975° C. for several weeks, with continuous >1000-hour exposure to both $Na_3AlF_6$, $Al_2O_3$, $CaF_2$, and $O_2$ gas, by submerging samples of the ingots into molten cryolite having a temperature of 975° C. After roughly 1000 hours, the samples were collected from the cryolite melt and analysed using optical microscope and scanning electron microscope with energy-dispersive X-ray spectroscopy (SEM-EDS)

In all cases, the alloy samples formed a multitude of stable oxides, fluorides and oxy-fluorides at their external surfaces, with the typical mineral compositions listed above. The outer mineral layers were clearly visible in the cross-sections of metallographic samples after cryolite testing. SEM-EDS could pinpoint and detect specific mineral compounds, both on the surface and in the bulk of the material. Electrical conductivity tests were also performed on the mineral layers. The fact that stable, non-dissolving, mineral layers form on the alloys bodes well for high-purity aluminium production.

The results of the testing of the four alloys (Alloy 1-4, with compositions according to Tables 1-4, respectively), are summarised below, with reference to micrographs taken at the samples after cryolite testing.

Alloy 1

TABLE 1

| Alloy 1 composition (at %). | |
|---|---|
| 57.3 | Ni |
| 17.7 | Cr |
| 3.2 | Mn |
| 0.8 | Nb/Ta |
| 0.8 | Fe |
| 0.8 | Ti |
| 8.7 | Zr |
| 9.7 | Sn |
| 1.0 | B |

Assessment after cryolite testing as described above: no major corrosion on the surface, sample intact, no spalling, light blue appearance at surface, shiny metallic alloy underneath the mineral layer, electrically conductive.

In the bulk alloy, at least one of the following intermetallics formed, as specified by SEM-EDS: $Cr_2B$, $Nb_3B_2$, $ZrNi_5$ and $ZrNi_2Sn$.

Mineral layers at surface: numerous phases and solid-solutions of zirconolite, schiavinatoite, ixiolite, kobeite, etc.

Figure 1:
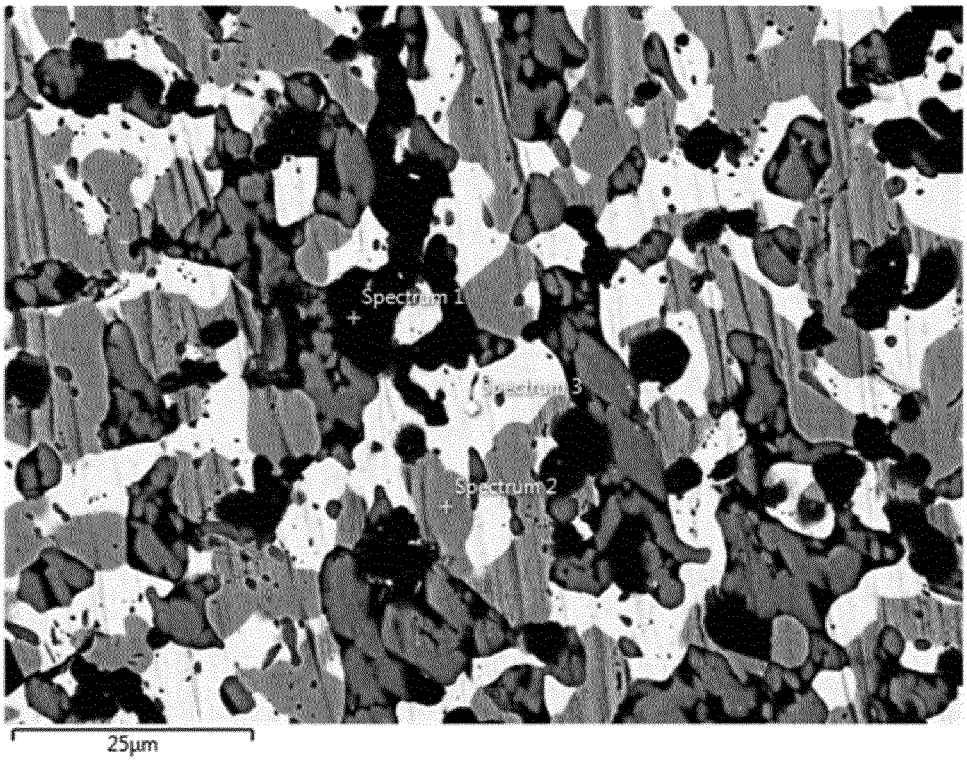
FIG. 1 shows a micrograph of the external surface of an alloy according to the invention, after cryolite testing.

Alloy 1 is a multicomponent metallic alloy comprising distinct equilibrium phases, as specified by SEM-EDS. FIG. 1 is a micrograph showing the external surface of the alloy after cryolite testing. The external surface shows i) Solid solution of Ni—Cr—Sn with small additions of Nb, Ta, Zr, Fe, Mn, Ti.

ii) Mixed mineral layer, comprising zirconolite, schiavinatoite, ixiolite, kobeite, etc. NB. traces of Na, Ca, Al and F come from the cryolite salt mixture The entropy of mixing for alloy 1 was calculated using formula 1 to $S_{mix}$=1.34 R.

Alloy 2

TABLE 2

| Alloy 2 composition (at %). | |
|---|---|
| 52.6 | Ni |
| 16.2 | Cr |
| 3.0 | Mn |
| 0.8 | Nb/Ta |
| 0.7 | Fe |
| 0.7 | Ti |
| 9.0 | Zr |
| 9.0 | Si |
| 3.0 | Ca |
| 0.7 | Ce |
| 2.9 | Sn |
| 1.1 | Gd |
| 0.3 | Nd |

Assessment after cryolite testing as described above: no major corrosion on the surface, sample intact, no spalling, brown-green appearance at surface, shiny metallic alloy underneath the mineral layer, electrically conductive.

In the bulk alloy, the following intermetallics formed, as determined by SEM-EDS: ZrSi and $(Ce,Gd,Nd,Ca)Ni_5Sn$ Mineral layers at surface: numerous phases and solid-solutions of zirconolite, euxenite, gagarinite, ixiolite, tapiolite etc.

Figure 2:
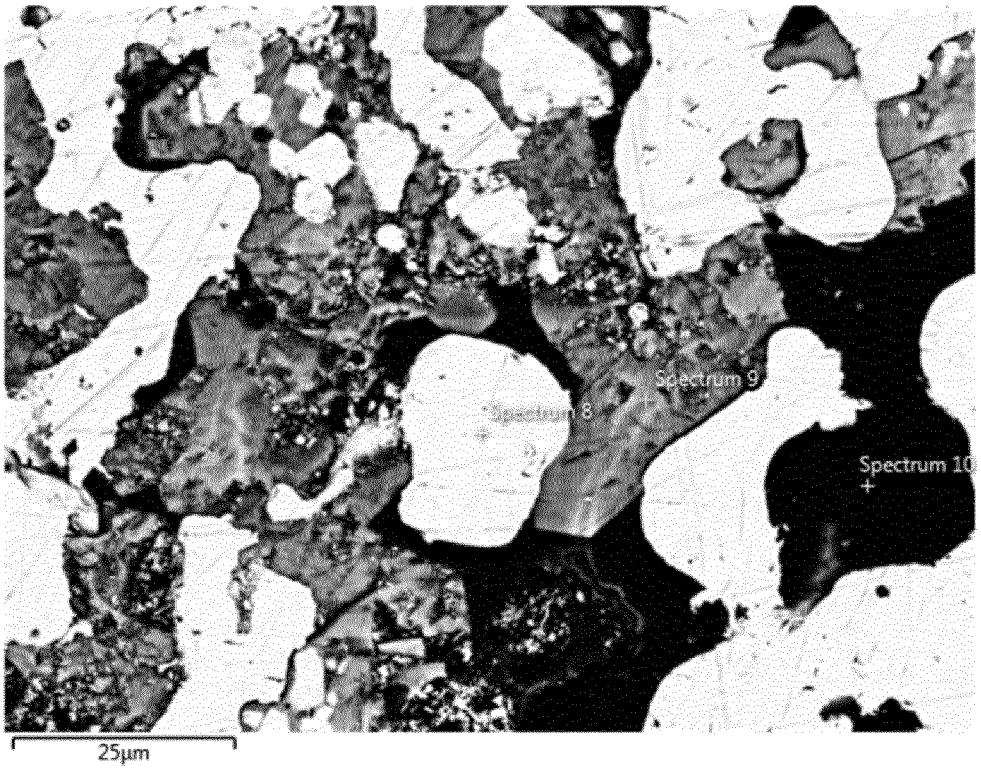
FIG. 2 shows a micrograph of the external surface of an alloy according to the invention, after cryolite testing.

Alloy 2 is a multicomponent metallic alloy comprising three distinct equilibrium phases, as specified by SEM-EDS. FIG. 2 is a micrograph showing the external surface of the alloy after cryolite testing. The external surface shows i) Solid solution of Ni—Cr—Nb—Sn with small additions of Zr, Ta, Fe, Mn, Ti, Si.

ii) Mixed mineral layer, comprising zirconolite, euxenite, gagarinite, ixiolite, tapiolite, etc. NB. traces of Na, Ca, Al and F come from the cryolite salt mixture.

The entropy of mixing for alloy 2 was calculated using formula 1 to $S_{mix}$=1.59 R.

Alloy 3

TABLE 3

| Alloy 3 composition (at %). | |
|---|---|
| 60.72 | Ni |
| 14.18 | Sn |
| 7.78 | Nb/Ta |
| 9.52 | Cr |
| 3.20 | B |
| 2.76 | Mn |
| 0.92 | Fe |
| 0.92 | Ti |

Assessment after cryolite testing as described above: no major corrosion on the surface, sample intact, no spalling, grey-blue appearance at surface, shiny metallic alloy underneath the mineral layer, electrically conductive.

Mineral layers at surface: numerous phases and solid-solutions of schiavinatoite, béhierite, ixiolite, tapiolite, fersmite etc.

Figure 4A:
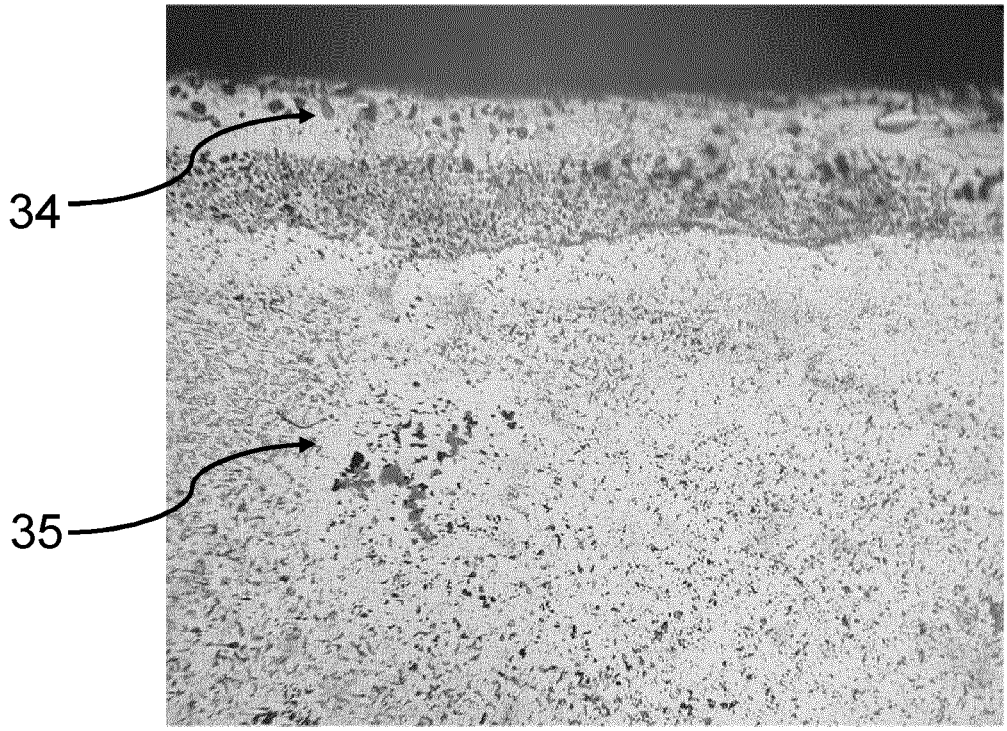
FIGS. 4A and B shows micrographs of the cross-section of the alloy, showing both the bulk and the intrinsic coating, after cryolite testing.
Figure 4B:
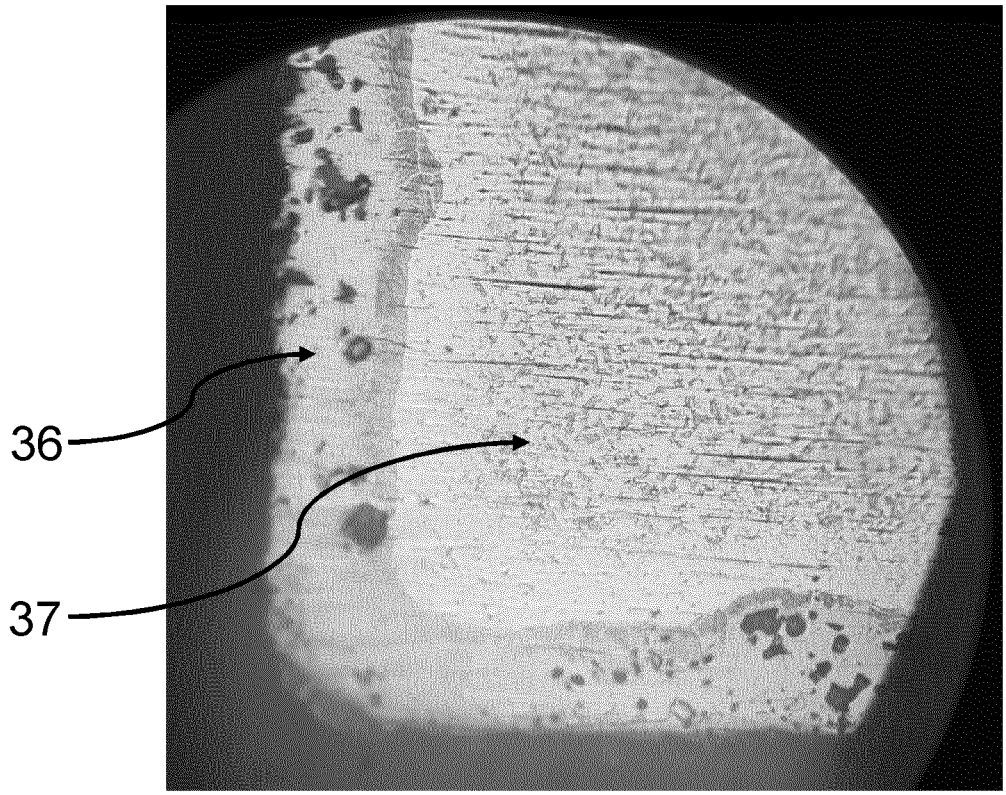

A cross-section of Alloy 3 is shown in FIGS. 4A and B. The cross-sections of the alloy show multi-component metallic alloy interior 35, 37 and the mineral coating on the external surface 34, 36 comprising a combination of schiavinatoite, béhierite, ixiolite, tapiolite, fersmite, etc (specified by SEM-EDS).

Figure 3:
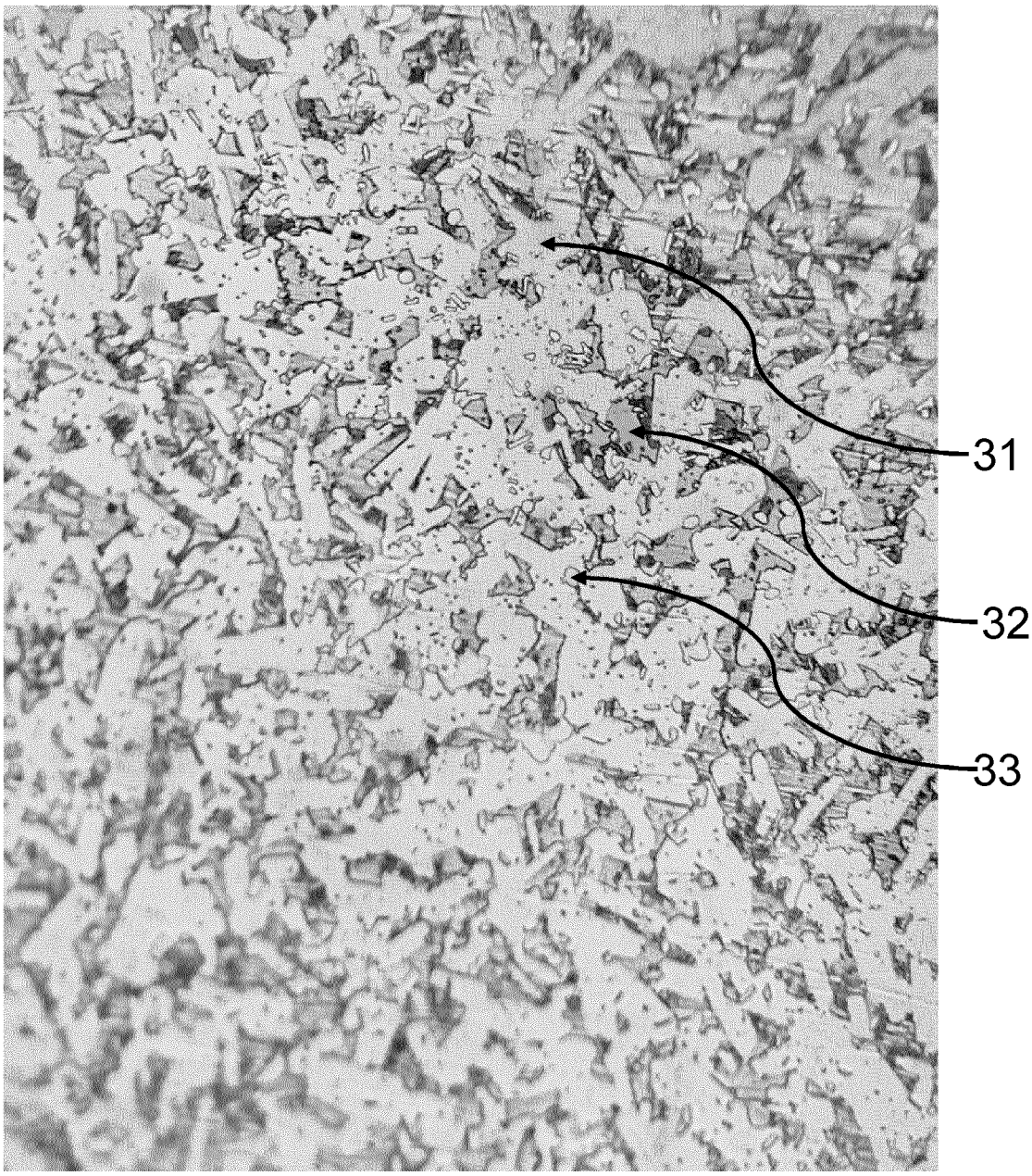
FIG. 3 shows a micrograph of the bulk, in cross-section, of an alloy according to the invention, after cryolite testing.

Another micrograph of Alloy 3 is shown as FIG. 3, taken at a cross-section of the metal alloy, in the bulk of the metal alloy. FIG. 3 shows three distinct equilibrium phases (having been specified with SEM-EDS):

i) Solid solution of Ni—Cr—Nb, with small additions of Ta, Fe, Mn, Ti, Sn with a volume fraction of approximately 45 vol %, 31.

ii) Intermetallic of $Ni_3Sn$, with small additions of Nb, Ta, Fe, Mn, Ti with a volume fraction of approximately 45 vol %, 32.

iii) Intermetallic of $Nb_3B_2$, with small additions of Ta, Cr, Ti, Ni, with a volume fraction of approximately 10 vol %, 33.

The entropy of mixing for alloy 3 was calculated using formula 1 to $S_{mix}$=1.30 R.

Alloy 4

TABLE 4

| Alloy 4 composition (at %). | |
|---|---|
| 67.53 | Ni |
| 15.16 | Sn |
| 4.03 | Nb/Ta |
| 4.81 | Cr |

TABLE 4-continued

| Alloy 4 composition (at %). | |
|---|---|
| 5.17 | Ce/La |
| 1.98 | Mn |
| 0.66 | Fe |
| 0.66 | Ti |

Assessment after cryolite testing as described above: no major corrosion on the surface, sample intact, no spalling, light green appearance at surface, shiny metallic alloy underneath the mineral layer, electrically conductive.

Figure 6A:
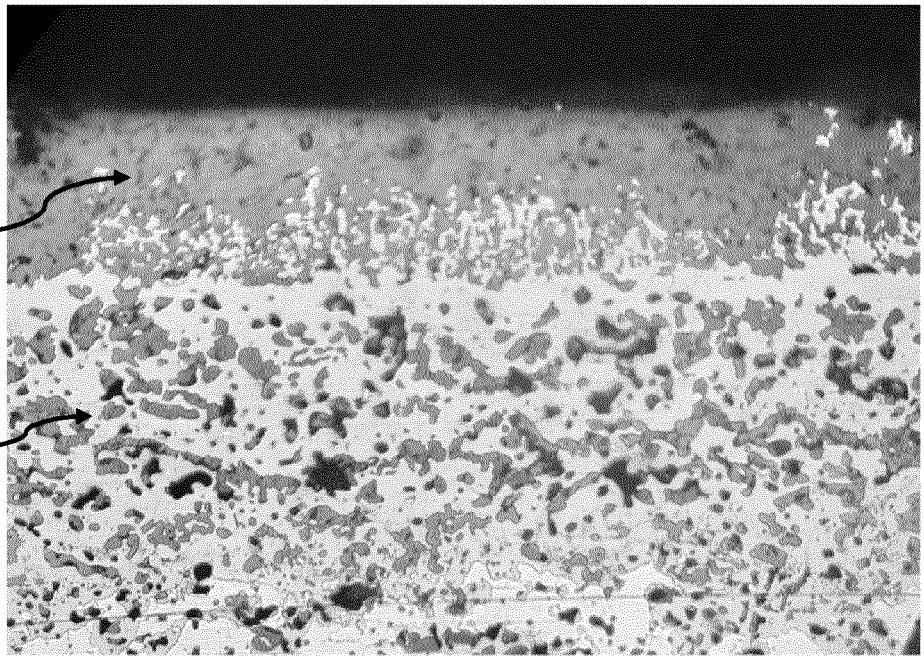
FIGS. 6A and B shows micrographs of the cross-section of the alloy, showing both the bulk and the intrinsic coating, after cryolite testing.
Figure 6B:
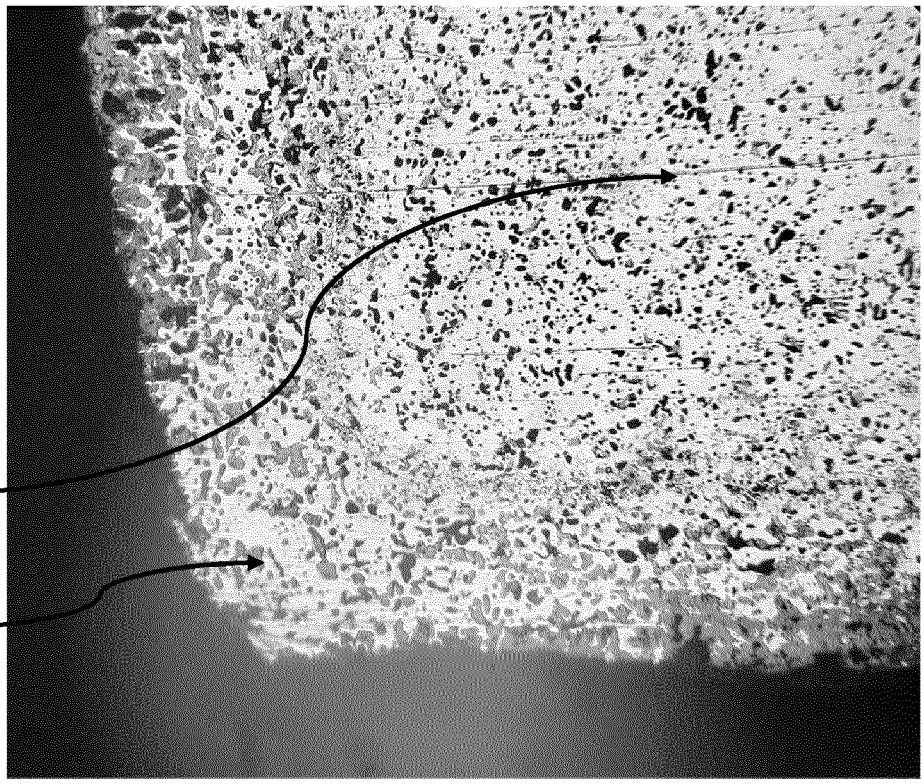
Figure 7:
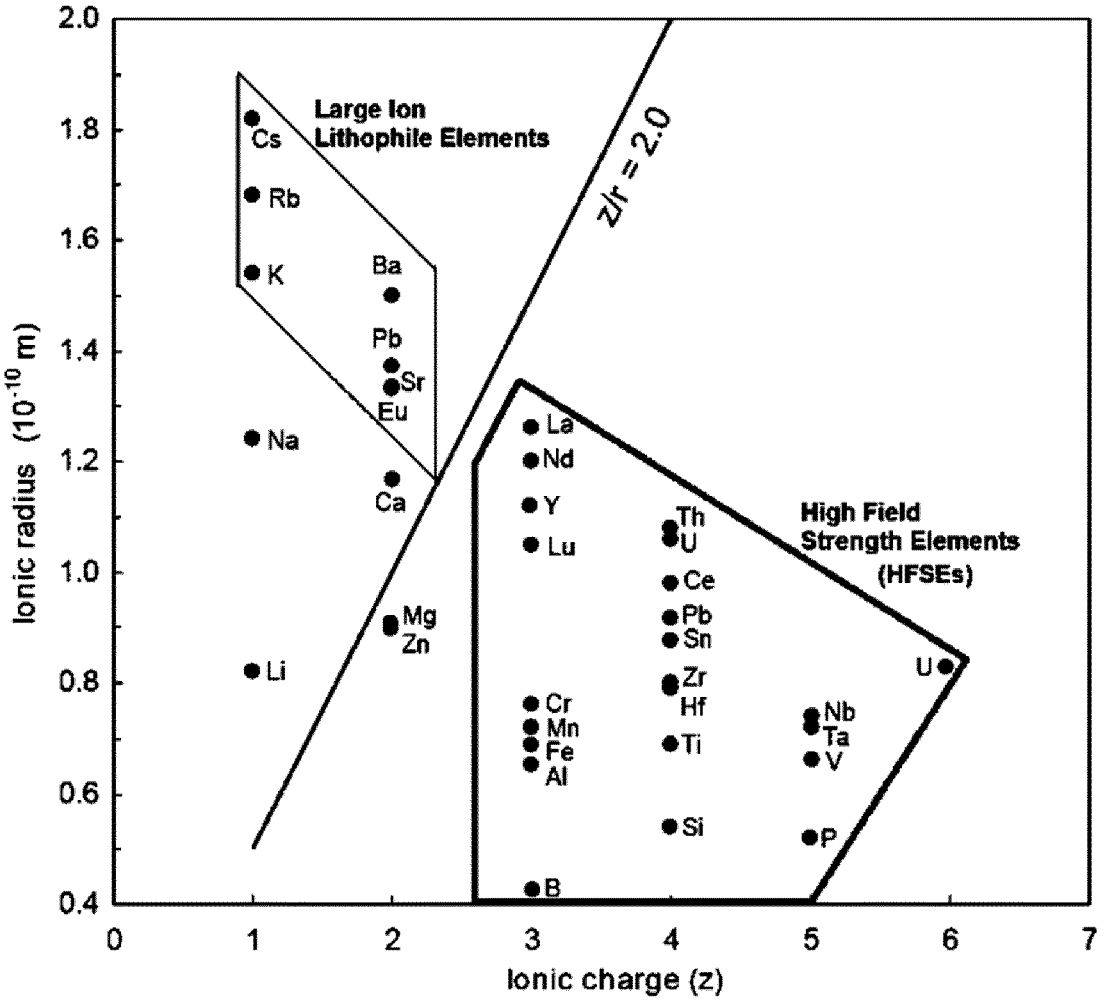
FIG. 7 show ionic radius plotted against the ionic charge for numerous elements.

Mineral layers at surface: numerous phases of wodginite, aeschynite, ixiolite, tapiolite, fersmite etc FIGS. 6A and B show micrographs of Alloy 4. The micrograph shows a cross-section of the multi-metal component metallic alloy interior 45, 46 and the mineral coating on the external surface 44, 47, comprising a combination of wodginite, aeschynite, ixiolite, tapiolite, fersmite, etc (specified by SEM-EDS).

Figure 5:
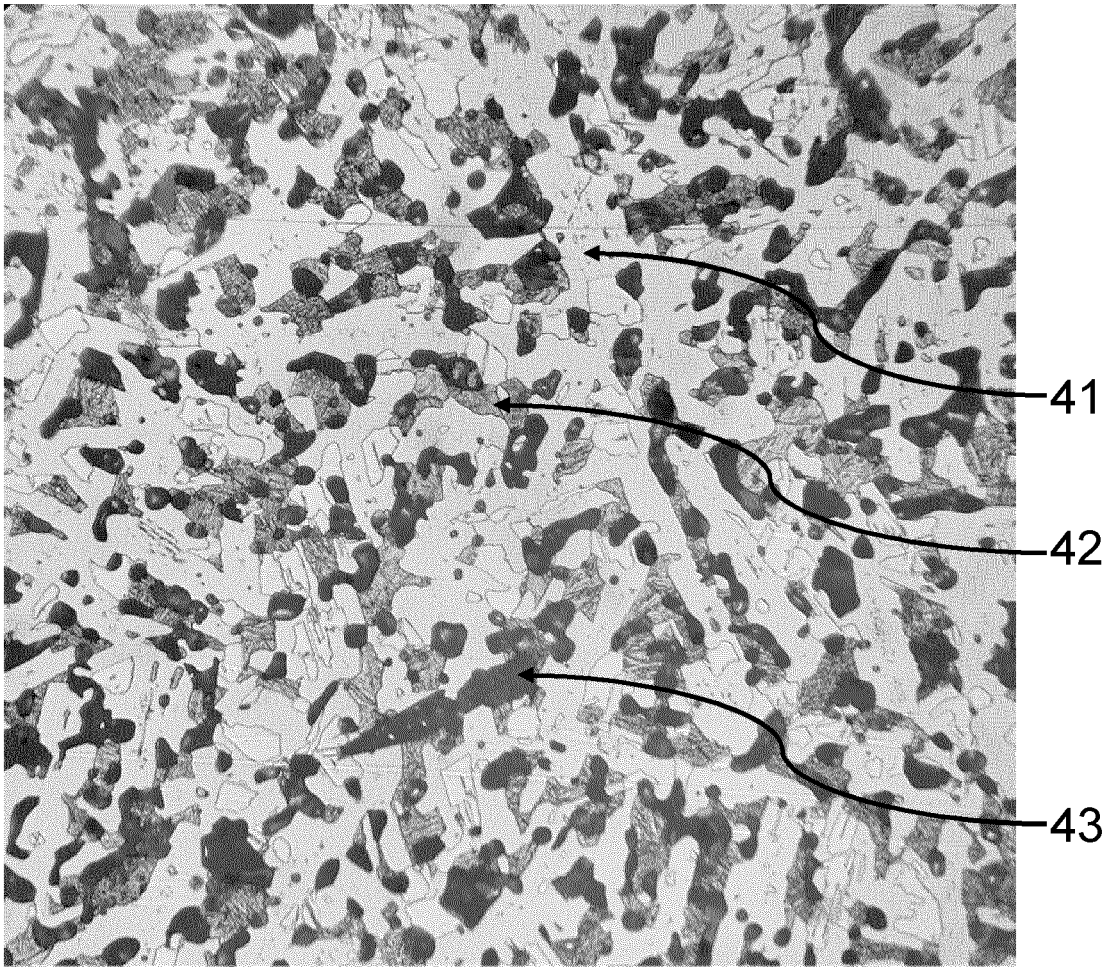
FIG. 5 shows a micrograph of the bulk, in cross-section, of an alloy according to the invention, after cryolite testing.

FIG. 5 shows a micrograph of alloy taken at a cross-section of the metal alloy, in the bulk of the metal alloy, which shows a multicomponent metallic alloy comprising three distinct equilibrium phases, as specified by SEM-EDS:

i) solid solution of Ni—Cr—Nb, with small additions of Ta, Fe, Mn, Ti, Sn with a volume fraction of approximately 35 vol-%, 41.

ii) Intermetallic of $Ni_3Sn$, with small additions of Nb, Ta, Fe, Mn, Ti, with a volume fraction of approximately 35 vol-%, 42.

iii) intermetallic of (Ce, La)$Ni_5Sn$, with small additions of Ta, Cr, Ti, Ni, with a volume fraction of approximately 30 vol-%, 43.

The entropy of mixing for alloy 4 was calculated using formula 1 to $S_{mix}$=1.15 R.

Thus, it has been shown that metal alloys according to the present invention can form a coating as described above. Therefore, the alloys are capable of withstanding molten cryolite having a temperature of >975° C., in an oxygen containing atmosphere for at least 1000 hours. Furthermore, it has been shown that the inventive metal alloy, in which the amounts of specific HFSE can vary significantly. In the four metal alloys, the amount of the various elements varies according to table 5, which shows the lowest and highest amount of each element in the alloys 1-4. Clearly, the properties of the metal alloy are not so much governed by the specific HFSE elements, but rather by the fact that the metal alloy comprises a sufficient total amount of HFSE. This is supported by the findings in the Pitinga mine, from which it is clear that HFSE elements are present in minerals capable of withstanding molten cryolite.

TABLE 5

| Elements and their lowest and highest amount in alloys 1-4. | | |
|---|---|---|
| Element | Lowest amount | Highest amount |
| Ni | 52.6 | 67.53 |
| Sn | 2.9 | 15.16 |
| Nb/Ta | 0.8 | 7.78 |
| Cr | 4.81 | 17.7 |
| Mn | 1.98 | 3.2 |
| Fe | 0.66 | 0.92 |
| Ti | 0.8 | 0.92 |
| Zr | 9 | 9.7 |
| B | 1 | 3.2 |
| Si | 9 | 9 |
| Ca | 3 | 3 |

TABLE 5-continued

| Elements and their lowest and highest amount in alloys 1-4. | | |
|---|---|---|
| Element | Lowest amount | Highest amount |
| Ce/La | 0.7 | 5.17 |
| Gd | 1.1 | 1.1 |
| Nd | 0.3 | 0.3 |

Clearly, the HFSE elements of the metal alloy can be varied significantly, while still yielding a metal alloy capable of withstanding molten cryolite having a temperature of >975° C., in an oxygen containing atmosphere for at least 1000 hours. It is contemplated that a Ni in amount of at least 35 atom-%, and a remainder comprising a majority of HFSE elements are capable of forming the metal alloy according to the invention. The total amount of HFSE elements in the metal alloy may be 20-65 atom-%, such as 20-60 atom-%, preferably 25-55 atom-%, such 30-50 atom-%. Furthermore, the number of HFSE elements in the metal alloy may be at least 3, such as at least 4, or at least 5, or at least 6, or at least 7 or at least 8 or at least 9 or at least 10, or at least 11, or at least 12, or at least 13, or at least 14, such as at least 15. The number of HFSE elements in the metal alloy may be 5-5 elements, such as 5-14 elements, preferably 6-14 elements such as 8-14 elements. The term "HFSE elements" refers to Sn, Nb, Ta, B, Cr, Ce, Fe, La, Nd, Sm, Gd, Ti, Zr, Mn, Hf, Si, P, Al, Y and V.

Itemized list of embodiments

General Items

1. A conductive multicomponent metal alloy having the following composition (in atom-%)

Ni, in a total amount of 35-70; wherein the remaining 30-65 comprises at least three elements selected from the list consisting of Sn, Nb, Ta, B, Cr, Ce, Fe, La, Rare earth elements (REEs), Ti, Zr, Mn, Hf, Si, P, Al and V in a total amount of at least 30; wherein the metal alloy comprises at least three distinct crystalline phases, at least one phase being an intermetallic phase.
2. The metal alloy according to item 1, wherein the metal alloy comprises at least four elements selected from the list consisting of Sn, Nb, Ta, B, Cr, Ce, Fe, La, Nd, Sm, Gd, Ti, Zr, Mn, Hf, Si, P, Al, Y and V, in a total amount of 20-65.
3. The metal alloy according to item 1 or 2 comprising (in atom-%)

Sn in a total amount of 1-25

Nb and/or Ta in total amount of 0.1-20 and one or several elements selected from the list consisting of B, Cr, Ce, Fe, La, Nd, Sm, Gd, Ti, Zr, Mn, Hf, Si, P, Al and V, in a total amount of from 10-55.
4. The metal alloy according to any one of items 1-3 comprising (in atom-%)

Sn in a total amount of 1-20

Nb and/or Ta in a total amount of 0.5-10 and, one or several elements selected from the consisting of B, Cr, Ce, Fe, La, Nd, Sm, Gd, Ti, Zr, Mn, Hf, Si, P, Al, Y and V in a total amount of from 10-50.
5. The metal alloy according any one of the preceding items, wherein the metal alloy comprises 4-10 elements selected from the list consisting of Sn, Nb, Ta, B, Cr, Ce, Fe, La, Nd, Sm, Gd, Ti, Zr, Mn, Hf, Si, P, Al, Y and V.
6. The metal alloy according to item 5, wherein the metal alloy comprises 5-8 elements selected from the list consisting of Sn, Nb, Ta, B, Cr, Ce, Fe, La, Nd, Sm, Gd, Ti, Zr, Mn, Hf, Si, P, Al, Y and V.

7. The metal alloy according to any one of items 3-6, wherein said metal alloy consist of consists of 4 to 15 elements.

8. The metal alloy according to any one of the preceding items, comprising Cr in a total amount of 3-20 atom-%.

9. The metal alloy according to any one of the preceding items, comprising Mn in a total amount of 1-5 atom-%.

10. The metal alloy according to any one of the preceding items, comprising Fe in a total amount of 0.1-3 atom-%.

11. The metal alloy according to any one of the preceding items, comprising Ti in a total amount of 0.1-3 atom-%.

12. The metal alloy according to any one of the preceding items, wherein the total amount of Sn is in the range of 1-20 atom-%.

13. The metal alloy according to any one of the preceding items, wherein the total amount of Nb and/or Ta in the metal alloy is in the range of from 0.1-10 atom-%.

14. The metal alloy according to any one of the preceding items, wherein the balance is Ni, and optionally naturally occurring impurities.

15. The metal alloy according to item 5, wherein the amount of Ni in the metal alloy is in the range of from 40-70 atom-%.

16. The metal alloy according any one of the preceding items, having the following composition (in atom-%)

| | |
|---|---|
| Ni | 35-75, wherein the remaining 25-65 comprises |
| Cr | 1-25 |
| Mn | 1-10 |
| Nb and/or Ta | 0.1-10 |
| Fe | 0.1-5 |
| Ti | 0.1-5 |
| Sn | 1-20 |
| in a total amount of at least 25 | |
| and, optionally, | |
| Zr | ≤15 |
| B | ≤10 |
| Si | ≤15 |
| Ce and/or La | ≤10 |
| Gd | ≤5 |
| Nd | ≤5 |
| Sm and/or Y | ≤10 |
| Hf | ≤10 |
| P | ≤10 |
| Al | ≤10 |
| V | ≤10 |
| Ca | ≤10 |
| in a total amount no more than 30. | |

17. The metal alloy according to item 16, having the following composition (in atom-%)

| | |
|---|---|
| Cr | 3-20 |
| Mn | 1-4 |
| Nb and/or Ta | 0.5-10 |
| Fe | 0.4-1.2 |
| Ti | 0.4-1.2 |
| Sn | 1-20 |
| and, optionally, | |
| Zr | 7-12 |
| B | 0.3-4 |
| Si | 5-14 |
| Ce and/or La | 0.3-8 |
| Gd | 0.5-2 |
| Nd | 0.1-1 |
| Sm | 0.1-10 |
| Hf | 0.1-10 |

-continued

| | |
|---|---|
| P | 0.1-10 |
| Al | 0.1-10 |
| V | 0.1-10 |

the balance being Ni in an amount of at least 45 atom-%, and optionally other naturally occurring impurities.

18. The metal alloy according to item 16, wherein the metal alloy comprises (in atom-%)

| | |
|---|---|
| Ni | 53-63, and wherein the remaining 37-47 comprises |
| Cr | 1-25 |
| Mn | 1-10 |
| Nb and/or Ta | 0.1-10 |
| Fe | 0.1-5 |
| Ti | 0.1-5 |
| Zr | 1-15 |
| Sn | 1-25 |
| B | 0.1-10 |
| in a total amount of at least 37. | |

19. The metal alloy according to item 18, wherein the metal alloy comprises (in atom-%)

| | |
|---|---|
| Cr | 15-20 |
| Mn | 1-5 |
| Nb and/or Ta | 0.1-1.5 |
| Fe | 0.1-1.5 |
| Ti | 0.1-1.5 |
| Zr | 5-15 |
| Sn | 5-15 |
| B | 0.3-2 |

the balance being Ni and optionally other naturally occurring impurities.

20. The metal alloy according to item 16, wherein the metal alloy comprises (in atom-%)

| | |
|---|---|
| Ni | 47-57, wherein the remaining 43-53 comprises, |
| Cr | 1-25 |
| Mn | 1-10 |
| Nb and/or Ta | 0.1-10 |
| Fe | 0.1-5 |
| Ti | 0.1-5 |
| Zr | 1-15 |
| Sn | 1-25 |
| Si | 1-15 |
| Ce and/or La | 0.1-10 |
| Gd | 1-5 |
| Nd | 0.1-5 |
| in a total amount of at least 43. | |

21. The metal alloy according to item 20, wherein the metal alloy comprises (in atom-%)

| | |
|---|---|
| Cr | 10-20 |
| Mn | 1-5 |
| Nb and/or Ta | 0.1-1.5 |
| Fe | 0.1-1.5 |
| Ti | 0.1-1.5 |
| Zr | 5-15 |
| Sn | 5-15 |
| Si | 5-15 |
| Ce/La | 0.1-1.5 |
| Gd | 0.1-5 |
| Nd | 0.1-5 |

the balance being Ni and optionally other naturally occurring impurities.

22. The metal alloy according to item 16, wherein the metal alloy comprises (in atom-%)

| | |
|---|---|
| Ni | 55-65, wherein the remaining 45-55 comprises, |
| Cr | 1-25 |
| Mn | 1-10 |
| Nb and/or Ta | 0.1-10 |
| Fe | 0.1-5 |
| B | 1-10 |
| Sn | 1-25 |
| Ti | 0.1-5 |
| in a total amount of at least 45. | |

23. The metal alloy according to item 22, wherein the metal alloy comprises (in atom-%)

| | |
|---|---|
| Cr | 5-15 |
| Mn | 1-5 |
| Nb and/or Ta | 5-10 |
| Fe | 0.1-1.5 |
| B | 1-5 |
| Sn | 10-20 |
| Ti | 0.1-1.5 |

the balance being Ni and optionally other naturally occurring impurities.

24. The metal alloy according to item 16, wherein the metal alloy comprises (in atom-%)

| | |
|---|---|
| Ni | 63-73, wherein the remaining 27-37 comprises |
| Cr | 1-25 |
| Mn | 1-10 |
| Nb and/or Ta | 0.1-10 |
| Ce and/or La | 1-10 |
| Fe | 0.1-5 |
| Sn | 8-22 |
| Ti | 0.1-5 |
| in a total amount of at least 27. | |

25. The metal alloy according to item 24, wherein the metal alloy comprises (in atom-%)

| | |
|---|---|
| Cr | 1-10 |
| Mn | 1-3 |
| Nb and/or Ta | 2-7 |
| Ce and/or La | 3-7 |
| Fe | 0.1-1.5 |
| Sn | 10-20 |
| Ti | 0.1-1.5 |

the balance being Ni and optionally other naturally occurring impurities.

26. The metal alloy according to any one of the preceding items, wherein the metal alloy has a compositional entropy S at least 1.0R, as calculated by formula 1, R being the gas constant.

27. The metal alloy according to any one of the preceding items, wherein said metal alloy is adapted to form, upon contact with oxygen and a molten salt comprising fluoride, an intrinsic surface coating comprising at least one oxide, fluoride or oxyfluoride selected from the list of IMA approved minerals consisting of:

| | |
|---|---|
| Zircon | (Zr, Hf)$SiO_4$ |
| Hafnon | (Hf, Zr)$SiO_4$ |
| Stetindite | (Ce, REE)$SiO_4$ |

-continued

| | |
|---|---|
| Xenotime | (Y, Ce, La, REE)$PO_4$ |
| Wakefieldite | (Ce, La, Y, Nd, Pb)$VO_4$ |
| Schiavinatoite | (Nb, Ta)$BO_4$ |
| Béhierite | (Ta, Nb)$BO_4$ |
| Ixiolite | (Ta, Nb, Sn, Fe, Mn, Zr, Hf, Ti)$_4O_8$ |
| Wodginite | (Mn, Ti, Sn, Fe, Ce, La)(Ta, Nb)$_2O_8$ |
| Samarskite | (Y, Fe, Mn, REE, Th, U, Ca)$_2$(Nb, Ta, Ti)$_2O_8$ |
| Euxenite | (Y, Ca, Ce, La, Th, U)(Nb, Ta, Ti)$_2O_6$ |
| Polycrase | (Y, Ca, Ce, La, Th, U)(Ti, Nb, Ta)$_2O_6$ |
| Tapiolite | (Fe, Mn)(Ta, Nb)$_2O_6$ |
| Fersmite | (Ca, Ce, La, Na)(Nb, Ta, Sn, Ti)$_2O_5F$ |
| Aeschynite | (Ce, Ca, Fe, Th, Nd, Y)(Ti, Nb)$_2O_6$ |
| Fluornatromicrolite | (Na, Ca, Ce, La, REE, U, Pb)$_2$(Ta, Nb, Sn, Ti)$_2O_6F$ |
| Zirconolite | (Ca, Y, REE)Zr(Ti, Nb, Al, Fe)$_2O_6F$ |
| Kobeite | (REE, Fe, U)$_3$Zr(Ti, Nb)$_3O_{12}$ |
| Gagarinite | Na(Ca, Ce, La, Y, REE)$_2F_6$ |
| Davidite | (La, Ce, Ca)(Y, U)(Ti, Fe)$_{20}O_{38}$ |
| Fluocerite | (Ce, La, Y, REE, Ca)$F_3$ |
| Simpsonite | $Al_4$(Ta, Nb, Sn, Ti)$_3O_{13}$ |
| Albite | (Na, Ca)$AlSi_3O_8$ |
| Wöhlerite | $NaCa_2$(Zr, Hf, Nb, Ta, Ti)$Si_2O_7F_2$ |
| Nioboholtite | (Nb, Ta)$Al_6BSi_3O_{18}$ |
| Vigezzite | (Ca, Ce, La)(Nb, Ta, Ti)$_2O_6$) |
| Loparite-Ce | Na(Ce, La, REE)(Ti, Nb, Ta)$_2O_6$ |
| Vlasovite | ($Na_2ZrSi_4O_{11}$) |
| Normandite | (NaCa(Mn, Fe)(Ti, Nb, Ta, Zr)($Si_2O_7$)OF) |
| Lakargiite | Ca(Zr, Sn, Ti)$O_3$ |
| Foordite | Sn(Nb, Ta)$_2O_6$ |
| Ainalite | Sn(Fe, Ta, Nb)$O_2$. |

28. The metal alloy according to any one of items 1-26, wherein the metal alloy further comprises, on at least one outer surface, an adherent, intrinsic surface coating comprising at least one oxide, fluoride or oxyfluoride selected from the list of IMA approved minerals consisting of:

| | |
|---|---|
| Zircon | (Zr, Hf)$SiO_4$ |
| Hafnon | (Hf, Zr)$SiO_4$ |
| Stetindite | (Ce, REE)$SiO_4$ |
| Xenotime | (Y, Ce, La, REE)$PO_4$ |
| Wakefieldite | (Ce, La, Y, Nd, Pb)$VO_4$ |
| Schiavinatoite | (Nb, Ta)$BO_4$ |
| Béhierite | (Ta, Nb)$BO_4$ |
| Ixiolite | (Ta, Nb, Sn, Fe, Mn, Zr, Hf, Ti)$_4O_8$ |
| Wodginite | (Mn, Ti, Sn, Fe, Ce, La)(Ta, Nb)$_2O_8$ |
| Samarskite | (Y, Fe, Mn, REE, Th, U, Ca)$_2$(Nb, Ta, Ti)$_2O_8$ |
| Euxenite | (Y, Ca, Ce, La, Th, U)(Nb, Ta, Ti)$_2O_6$ |
| Polycrase | (Y, Ca, Ce, La, Th, U)(Ti, Nb, Ta)$_2O_6$ |
| Tapiolite | (Fe, Mn)(Ta, Nb)$_2O_6$ |
| Fersmite | (Ca, Ce, La, Na)(Nb, Ta, Sn, Ti)$_2O5_F$ |
| Aeschynite | (Ce, Ca, Fe, Th, Nd, Y)(Ti, Nb)$_2O_6$ |
| Fluornatromicrolite | (Na, Ca, Ce, La, REE, U, Pb)$_2$(Ta, Nb, Sn, Ti)$_2O_6F$ |
| Zirconolite | (Ca, Y, REE)Zr(Ti, Nb, Al, Fe)$_2O_6F$ |
| Kobeite | (REE, Fe, U)$_3$Zr(Ti, Nb)$_3O_{12}$ |
| Gagarinite | Na(Ca, Ce, La, Y, REE)$_2F_6$ |
| Davidite | (La, Ce, Ca)(Y, U)(Ti, Fe)$_{20}O_{38}$ |
| Fluocerite | (Ce, La, Y, REE, Ca)$F_3$ |
| Simpsonite | Al4(Ta, Nb, Sn, Ti)$_3O_{13}$ |
| Albite | (Na, Ca)$AlSi_3O_8$ |
| Wöhlerite | NaCa2(Zr, Hf, Nb, Ta, Ti)$Si_2O7F_2$ |
| Nioboholtite | (Nb, Ta)$Al_6BSi_3O_{18}$ |
| Vigezzite | (Ca, Ce, La)(Nb, Ta, Ti)$_2O_6$) |
| Loparite-Ce | Na(Ce, La, REE)(Ti, Nb, Ta)$_2O_6$ |
| Vlasovite | ($Na_2ZrSi_4O_{11}$) |
| Normandite | (NaCa(Mn, Fe)(Ti, Nb, Ta, Zr)($Si_2O_7$)OF) |
| Lakargiite | Ca(Zr, Sn, Ti)$O_3$ |
| Foordite | Sn(Nb, Ta)$_2O_6$ |
| Ainalite | Sn(Fe, Ta, Nb)$O_2$. |

29. A conductive electrode for aluminum processing, comprising the alloy as defined in any one item 1-26.

30. The conductive electrode according to item 29, further comprising an intrinsic coating as defined in item 27 or 28.

31. The conductive electrode according to any one of items 29 or 30, wherein the electrode is an anode.
32. The conductive electrode according to any one of items 29 or 30, wherein the electrode is a cathode.
33. A method for forming an intrinsic coating on a metal alloy comprising
    providing a metal alloy as defined in any one of items 1-26;
    providing a molten salt composition comprising fluoride;
    submerging at least part of the metal alloy in the molten salt composition, thereby forming a mineral coating as defined in item 27 or 28.
34. The method according to item 30, wherein the molten salt comprises cryolite.
35. A method for manufacturing a metal alloy as defined in any one of the preceding items, comprising
    providing Ni;
    providing at least three elements selected from the list consisting of Sn, Nb, Ta, B, Cr, Ce, Fe, La, Nd, Sm, Gd, Ti, Zr, Mn, Hf, Si, P, Al, Y and V;
    melting the provided elements to form a melt;
    agitating said melt;
    solidifying said melt to form a metal alloy.

Abbreviations

Herein, the respective elements are referred to by their symbol in the periodic table.

The invention claimed is:

1. A conductive electrode for aluminum processing comprising:
a conductive multicomponent multiphase metal alloy; and
a coating on at least one outer surface of the conductive multicomponent multiphase metal alloy,
the conductive multicomponent multiphase metal alloy having the following composition (in atom-% of the metal alloy)
Ni, in a total amount of 35-70;
at least three elements selected from the list consisting of Sn, Nb, Ta, B, Cr, Ce, Fe, La, Nd, Sm, Gd, Ti, Zr, Mn, Hf, Si, P, Y and V in a total amount of at least 30-65;
the balance being Ni and optionally naturally occurring impurities in an amount of less than 0.4, wherein the conductive multicomponent multiphase metal alloy does not include aluminum; wherein
the metal alloy comprises at least three distinct crystalline phases, at least one phase being an intermetallic phase,
wherein the coating is selected from the list of IMA approved minerals consisting of:

| | |
|---|---|
| Zircon | $(Zr, Hf)SiO_4$ |
| Hafnon | $(Hf, Zr)SiO_4$ |
| Stetindite | $(Ce, REE)SiO_4$ |
| Xenotime | $(Y, Ce, La, REE)PO_4$ |
| Wakefieldite | $(Ce, La, Y, Nd, Pb)VO_4$ |
| Schiavinatoite | $(Nb, Ta)BO_4$ |
| Béhierite | $(Ta, Nb)BO_4$ |
| Ixiolite | $(Ta, Nb, Sn, Fe, Mn, Zr, Hf, Ti)_4O_8$ |
| Wodginite | $(Mn, Ti, Sn, Fe, Ce, La)(Ta, Nb)_2O_8$ |
| Samarskite | $(Y, Fe, Mn, REE, Th, U, Ca)_2(Nb, Ta, Ti)_2O_8$ |
| Euxenite | $(Y, Ca, Ce, La, Th, U)(Nb, Ta, Ti)_2O_6$ |
| Polycrase | $(Y, Ca, Ce, La, Th, U)(Ti, Nb, Ta)_2O_6$ |
| Tapiolite | $(Fe, Mn)(Ta, Nb)_2O_6$ |
| Fersmite | $(Ca, Ce, La, Na)(Nb, Ta, Sn, Ti)_2O_5F$ |
| Aeschynite | $(Ce, Ca, Fe, Th, Nd, Y)(Ti, Nb)_2O_6$ |
| Fluornatromicrolite | $(Na, Ca, Ce, La, REE, U, Pb)_2(Ta, Nb, Sn, Ti)_2O_6F$ |
| Zirconolite | $(Ca, Y, REE)Zr(Ti, Nb, Al, Fe)_2O_6F$ |
| Kobeite | $(REE, Fe, U)_3Zr(Ti, Nb)_3O_{12}$ |
| Gagarinite | $Na(Ca, Ce, La, Y, REE)_2F_6$ |
| Davidite | $(La, Ce, Ca)(Y, U)(Ti, Fe)_{20}O_{38}$ |
| Fluocerite | $(Ce, La, Y, REE, Ca)F_3$ |

-continued

| | |
|---|---|
| Simpsonite | $Al_4(Ta, Nb, Sn, Ti)_3O_{13}$ |
| Albite | $(Na, Ca)AlSi_3O_8$ |
| Wöhlerite | $NaCa_2(Zr, Hf, Nb, Ta, Ti)Si_2O_7F_2$ |
| Nioboholtite | $(Nb, Ta)Al_6BSi_3O_{18}$ |
| Vigezzite | $(Ca, Ce, La)(Nb, Ta, Ti)_2O_6)$ |
| Loparite-Ce | $Na(Ce, La, REE)(Ti, Nb, Ta)_2O_6$ |
| Vlasovite | $(Na_2ZrSi_4O_{11})$ |
| Normandite | $(NaCa(Mn, Fe)(Ti, Nb, Ta, Zr)(Si_2O_7)OF)$ |
| Lakargiite | $Ca(Zr, Sn, Ti)O_3$ |
| Foordite | $Sn(Nb, Ta)_2O_6$ |
| Ainalite | $Sn(Nb, Fe, Ta)O_2$. |

wherein the electrode is devoid of $FezNiO_4$ in both a bulk of the conductive multicomponent multiphase metal alloy and in an outer surface of the conductive multicomponent multiphase metal alloy.

2. The conductive electrode according to claim 1, wherein the metal alloy comprises at least four elements selected from the list consisting of Sn, Nb, Ta, B, Cr, Ce, Fe, La, Nd, Sm, Gd, Ti, Zr, Mn, Hf, Si, P, and V, in a total amount of 30-60 atom-% of the metal alloy.

3. The conductive electrode according to claim 1, wherein the metal alloy comprises 6-14 elements selected from the list consisting of Sn, Nb, Ta, B, Cr, Ce, Fe, La, Nd, Sm, Gd, Ti, Zr, Mn, Hf, Si, P, Y and V, in a total amount of 30-50 atom-% of the metal alloy.

4. The conductive electrode according to claim 1, the metal alloy having the following composition (in atom-% of the metal alloy)

| | |
|---|---|
| Ni | >35, and |
| Cr | 1-25 |
| Mn | 1-10 |
| Nb and/or Ta | 0.1-10 |
| Fe | 0.1-5 |
| Ti | 0.1-5 |
| Sn | 1-20 |

in a total amount of Cr, Mn, Nb, Ta, Fe and Ti of at least 20 and, optionally,

| | |
|---|---|
| Zr | ≤15 |
| B | ≤10 |
| Si | ≤15 |
| Ce and/or La | ≤10 |
| Gd | ≤5 |
| Nd | ≤5 |
| Sm and/or Y | ≤5 |
| Hf | ≤10 |
| P | ≤10 |
| Al | ≤10 |
| V | ≤10 |
| Ca | ≤10 |

in a total amount of Zr, B, Si, Ce, La, Gd, Nd, Sm, Y, Hf, P, V, Ca of no more than 45.

5. The conductive electrode according to claim 4, the metal alloy having the following composition (in atom-% of the metal alloy)

| | |
|---|---|
| Cr | 3-20 |
| Mn | 1-4 |
| Nb and/or Ta | 0.5-10 |
| Fe | 0.4-1.2 |
| Ti | 0.4-1.2 |
| Sn | 1-20 |

in a total amount of Cr, Mn, Nb, Ta, Fe and Ti of at least 20 and, optionally,

| | |
|---|---|
| Zr | 7-12 |
| B | 0.3-4 |
| Si | 5-14 |
| Ce and/or La | 0.3-8 |
| Gd | 0.5-2 |
| Nd | 0.1-1 |
| Sm and/or Y | 0.1-10 |
| Hf | 0.1-10 |
| P | 0.1-10 |
| Al | 0.1-10 |
| V | 0.1-10 |

in a total amount of Zr, B, Si, Ce, La, Gd, Nd, Sm, Y, Hf, P, V, Ca of no more than 45; the balance being Ni in an amount of at least 45 atom-%, and optionally other naturally occurring impurities.

6. The conductive electrode according to claim 4, wherein the metal alloy comprises (in atom-% of the metal alloy)

| | |
|---|---|
| Ni | 53-63; and |
| Cr | 10-25 |
| Mn | 1-10 |
| Nb and/or Ta | 0.1-5 |
| Fe | 0.1-5 |
| Ti | 0.1-5 |
| Zr | 5-15 |
| Sn | 5-15 |
| B | 0.1-3 |

in a total amount Cr, Mn, Nb, Ta, Fe, Ti, Zr, Sn and B of at least 37.

7. The conductive electrode according to claim 4, wherein the metal alloy comprises (in atom-% of the metal alloy

| | |
|---|---|
| Ni | 47-57, and |
| Cr | 10-25 |
| Mn | 1-5 |
| Nb and/or Ta | 0.1-5 |
| Fe | 0.1-5 |
| Ti | 0.1-5 |
| Zr | 5-15 |
| Sn | 1-5 |
| Si | 5-15 |
| Ce and/or La | 0.1-3 |
| Gd | 0.5-2 |
| Nd | 0.1-2 |

in a total amount Cr, Mn, Nb and Ta, Fe, Zr, Sn, Si, Ce, La, Gd and Nd of at least 43.

8. The conductive electrode according to claim 4, wherein the metal alloy comprises (in atom-% of the metal alloy)

| | |
|---|---|
| Ni | 55-65, and |
| Cr | 3-20 |
| Mn | 1-7 |
| Nb and/or Ta | 3-12 |
| Fe | 0.1-5 |
| B | 1-10 |
| Sn | 8-22 |
| Ti | 0.1-5 |

in a total amount of Cr, Mn, Nb, Ta, Fe, B, Sn, Ti of at least 45.

9. The conductive electrode according to claim 8, wherein the metal alloy comprises (in atom-% of the metal alloy)

| | |
|---|---|
| Cr | 5-15 |
| Mn | 1-5 |
| Nb and/or Ta | 5-10 |
| Fe | 0.1-1.5 |
| B | 1-5 |
| Sn | 10-20 |
| Ti | 0.1-1.5 |

the balance being Ni and optionally other naturally occurring impurities.

10. The conductive electrode according to claim 4, wherein the metal alloy comprises (in atom-% of the metal alloy)

| | |
|---|---|
| Ni | 63-73, and |
| Cr | 1-15 |
| Mn | 1-5 |
| Nb and/or Ta | 0.1-10 |
| Ce and/or La | 1-10 |
| Fe | 0.1-5 |
| Sn | 8-22 |
| Ti | 0.1-5 |

in a total amount of Cr, Mn, Nb, Ta, Ce, La, Fe, Sn, Ti of at least 27.

11. The conductive electrode according to claim 10, wherein the metal alloy comprises (in atom-% of the metal alloy)

| | |
|---|---|
| Cr | 1-10 |
| Mn | 1-3 |
| Nb and/or Ta | 2-6 |
| Ce and/or La | 3-7 |
| Fe | 0.1-1.5 |
| Sn | 10-20 |
| Ti | 0.1-1.5 |

the balance being Ni and optionally other naturally occurring impurities.

12. The conductive electrode according to claim 1, wherein the metal alloy has a compositional entropy $S_{mix}$ of at least 1.0R, R being the gas constant.

13. The conductive electrode according to claim 1, wherein the electrode is an anode.

14. The conductive electrode according to claim 1, wherein the electrode is a cathode.

15. A method for forming an intrinsic coating on a conductive electrode comprising:

providing a metal alloy as defined in claim 1;

providing a molten salt composition comprising fluoride; and submerging at least part of the metal alloy in the molten salt composition, thereby forming a mineral coating.

16. The method according to claim 15, wherein the molten salt comprises cryolite.

17. A method for oxidizing a conductive electrode comprising providing a metal alloy as defined in claim 1;

providing an oxygen containing atmosphere; and heating at least part of the metal alloy in the oxygen containing atmosphere, thereby forming at least one oxide.

18. A method for fluoridizing a conductive electrode comprising providing a metal alloy as defined in claim 1;

providing a fluoride containing atmosphere; and heating at least part of the metal alloy in the fluoride containing atmosphere, thereby forming at least one fluoride.

19. A method for manufacturing a conductive electrode comprising providing Ni in an amount of at least 35-70 atom-% of the metal alloy;

providing a total of 30-65 atom-% of at least three elements selected from the list consisting of Sn, Nb, Ta, B, Cr, Ce, Fe, La, Nd, Sm, Gd, Ti, Zr, Mn, Hf, Si, P, Al and V;

melting the provided elements to form a melt;

agitating said melt; and solidifying said melt to form a metal alloy.

20. The conductive electrode according to claim 2, wherein the metal alloy comprises at least five elements selected from the list consisting of Sn, Nb, Ta, B, Cr, Ce, Fe, La, Nd, Sm, Gd, Ti, Zr, Mn, Hf, Si, P, Y and V, in a total amount of 30-60 atom-% of the metal alloy.

21. The conductive electrode according to claim 1, wherein the metal alloy has a compositional entropy $S_{mix}$ of 1.1R-1.5R, R being the gas constant.

* * * * *